US007665609B2

(12) United States Patent
Liao et al.

(10) Patent No.: US 7,665,609 B2
(45) Date of Patent: Feb. 23, 2010

(54) AIR-TIGHTNESS STRENGTHENING AIR ENCLOSURE

(75) Inventors: Chian Hua Liao, Sindian (TW); Yao Sin Liao, Sindian (TW); Bo Xin Jian, Sindian (TW)

(73) Assignee: Yao Sin Liao, Sindian, Taipei County (TW)

( * ) Notice: Subject to any disclaimer, the term of this patent is extended or adjusted under 35 U.S.C. 154(b) by 167 days.

(21) Appl. No.: 11/758,545

(22) Filed: Jun. 5, 2007

(65) Prior Publication Data

US 2008/0080792 A1 Apr. 3, 2008

(30) Foreign Application Priority Data

Sep. 29, 2006 (TW) ..... 95136411 A

(51) Int. Cl.
*B65D 81/05* (2006.01)
*B65D 30/26* (2006.01)

(52) U.S. Cl. ..... 206/522; 383/3

(58) Field of Classification Search ..... 206/522; 383/3, 44; 137/512.15, 846; 441/88, 40, 441/80, 132; 114/68, 69, 360
See application file for complete search history.

(56) References Cited

U.S. PATENT DOCUMENTS

| | | | | |
|---|---|---|---|---|
| 4,155,453 | A | 5/1979 | Ono | |
| 4,850,912 | A * | 7/1989 | Koyanagi | 441/40 |
| 5,660,205 | A * | 8/1997 | Epstein | 137/512.15 |
| 6,827,099 | B2 | 12/2004 | Tanaka et al. | |
| 2004/0265523 | A1 | 12/2004 | Koyanagi et al. | |
| 2005/0103676 | A1* | 5/2005 | Lee | 206/522 |
| 2005/0189257 | A1* | 9/2005 | Chen et al. | 206/522 |
| 2006/0191817 | A1* | 8/2006 | Nishi et al. | 206/522 |

FOREIGN PATENT DOCUMENTS

| | | | |
|---|---|---|---|
| DE | 3812306 | A1 | 5/1989 |
| DE | 4007128 | A1 | 4/1991 |
| DE | 202004006032 | U1 | 9/2004 |
| JP | 08034478 | A | 2/1996 |
| JP | H08-034478 | A | 2/1996 |
| JP | 10-706 | | 1/1998 |
| JP | H10-236533 | A | 9/1998 |

(Continued)

*Primary Examiner*—Ehud Gartenberg
*Assistant Examiner*—King M Chu
(74) *Attorney, Agent, or Firm*—Apex Juris, pllc; Tracy M Heims

(57) ABSTRACT

An air-tightness strengthening air enclosure comprises two outer films folded together vertically and two inner films disposed between the two outer films, the two inner films are adhered to each other by means of hot sealing and an air filling passageway is formed on one end of the two outer films, the inner film and the single outer film are adhered to each other by means of hot sealing to form buffer rooms at one side of the air filling passageway and next, the two outer films are adhered to each other by means of hot sealing to form air chambers at one end of the air filling passageway, and the air chambers are communicated with the air filling passageway. Whereby, the air filling speed can be faster, and the air in the buffer room presses the two inner films to shield the air filling passageway to prevent the air from being leaked out after the air in the air chamber flows into the buffer room.

18 Claims, 26 Drawing Sheets

FOREIGN PATENT DOCUMENTS

| | | | |
|---|---|---|---|
| JP | 15072851 | A | 3/2003 |
| JP | 2003-292047 | A | 10/2003 |
| JP | 2005-162269 | A | 6/2005 |
| JP | 17193954 | A | 7/2005 |
| KR | 200390050 | | 7/2005 |
| KR | 100547578 | B1 | 1/2006 |
| KR | 1020070109019 | A | 11/2007 |
| TW | 00587049 | | 5/2004 |
| TW | M252680 | | 12/2004 |
| WO | 9009320 | A2 | 8/1990 |
| WO | 2004048077 | A1 | 6/2004 |
| WO | 2006085478 | A1 | 8/2006 |

* cited by examiner

AIR-TIGHTNESS STRENGTHENING AIR ENCLOSURE

CROSS-REFERENCES TO RELATED APPLICATIONS

This non-provisional application claims priority under 35 U.S.C. §119(a) on Patent Application No(s). 095136411 filed in Taiwan, R.O.C. on Sep. 29, 2006, the entire contents of which are hereby incorporated by reference.

FIELD OF INVENTION

The present invention relates to an air enclosure, and more particularly to an air enclosure with the air-tightness strengthening function.

BACKGROUND

Currently, when an article is packed, an air bubble paper or Styrofoam are mostly used to wrap the content thereof, and then place it into a paper box so as to prevent the content from being collided during transportation. However, the air bubble paper can be tightly attached on the surface of the content, but the collision preventing effect is not good. The volume of Styrofoam is bouffant to occupy very much space and is not easy to be decomposed by microorganism,' it will release poison gas dangerous to human body after incineration process to cause serious environmental pollution. For solving the deficits of the air bubble paper and Styrofoam mentioned above, an air packing bag made from resin is developed; it is sealed by means of hot sealing to form air cylinders and an air filling entrance for air filling is disposed thereon. After air is filled into the air cylinders via the air filling entrance, the air packing bag can then be taken as a cushioning material used in inside packing.

Please refer to FIGS. 1 and 2. FIG. 1 is a schematic view of a conventional air packing bag before air filling. FIG. 2 is a cross sectional view of a conventional air packing bag after air filling. The air packing bag comprises two outer films 21*a* and 21*b* folded together, in which the two outer films 21*a* and 21*b* are caused to adhere to each other by means of hot sealing, and an air filling passageway 22 and air chambers 23 are also formed by means of hot sealing. The two inner films 25*a* and 25*b* are adhered to each other between the two outer films 21*a* and 21*b* through hot sealing points 24*a*, 24*b*, 24*c* and 24*d* and allowed to side-attach onto the outer film 21*a* and in the meantime, the two inner films 25*a* and 25*b* are not adhered to each to form an air passageway 26. When the air in the air filling passageway 22 flows into the air chambers 23 via the air passageway 26 to cause them to be filled with air and expanded, the air in the air chamber 23 to thrust the two inner films 25*a* and 25*b* to shield the air chamber 23 so as to prevent the air in the air chamber 23 to be leaked out. For example, Japan utility model patent publishing No. H5-10706 entitled as "Manufacturing method for synthetic resin bag with check valve", Taiwan Patent No. 587049 titled as "Assembly structure of switch valve of air enclosure and manufacturing apparatus for enclosure with switch valve" and Taiwan Utility Model Patent No. M252680 entitled as "Air packing bag with reverse air locking sheet".

In such kind type of air enclosure, the air in the air chamber 23 will thrust the hot sealing point 24*b* to cause it to be loosed gradually to allow a gap to be generated between the two outer films 21*a* and 21*b* and the two inner films 25*a* and 25*b*. The air in the air chamber 23 will flow into the air filling passageway 22 via the gap generated after the hot sealing point 24*b* is loosed and the air is leaked out to the outside via the air filling passageway 22 to cause the air enclosure to be unable to be used. From the description mention above, for improving the structure of an air enclosure to allow the air in the air chamber to be prevented from being leaked out to cause the cushioning effect to be lost when hot sealing point thereof is thrust by the air and gradually loosed, and further to extend the air enclosure life, the present invention is proposed.

SUMMARY

One object of the present invention is to provide an air enclosure, relying on a buffer room to be used as an air storage space when the air in an air chamber is leaked out, and capable of directly filling the buffer room with air to allow it become an air-tightness strengthening apparatus so as to elevate the air filling speed and strengthen the air-tightness function.

For attaining to the object mentioned above, the present invention proposes an air-tightness strengthening air enclosure comprising two outer films folded together and two inner films disposed between the two outer films. The two inner films are adhered to each other by means of hot sealing to form an air filling passageway on one end of the two outer films, the inner film and one of the outer films are adhered to each other to form a buffer room by means of hot sealing on one side of the air filling passageway and thereafter, the two outer films are adhered to each other to form air chambers by means of hot sealing at one end of the air filling passage, and the air chambers are communicated with the air filling passageway. The air in the buffer room thrusts the inner film air filling passageway tightly to cause the air in the air chamber to be unable to flow back to strengthen the airtight function after air filling.

For attaining to the object mentioned above, the present invention also proposes an air-tightness strengthening air enclosure comprising a upper film and a lower film folded together and an inner film disposed between the upper and the lower films. The inner film and the upper film are adhered to each other by means of hot sealing to form an air filling passageway on one end of the upper and the lower films, the inner film and the lower film are adhered to each other to form a buffer room by means of hot sealing on one side of the air filling passageway and thereafter, the upper and the lower films are adhered to each other to form air chambers by means of hot sealing at one end of the air filling passage, and the air chambers are communicated with the air filling passageway. The air in the buffer room thrusts the inner film air filling passageway tightly to cause the air in the air chamber to be unable to flow back to strengthen the air-tightness function after air filling.

For attaining to the object mentioned above, the present invention also proposes an air-tightness strengthening air enclosure comprising two outer films folded together and two inner films disposed between the two outer films. The two inner films are adhered to each other by means of hot sealing to form an air filling passageway in the middle of the two outer films. The inner film and one of the outer films are adhered to form a buffer room by means of hot sealing on one side of the air filling passageway and thereafter, the two outer films are adhered to each other to form a plurality of air chambers by means of hot sealing respectively at two ends of the air filling passage, and each air chamber is communicated with the air filling passageway. The air in the buffer room thrusts the inner film air filling passageway tightly to cause the air in the air chamber to be unable to flow back to strengthen the air-tightness function after air filling.

For attaining to the object mentioned above, the present invention also proposes an air-tightness strengthening air enclosure comprising a upper film and a lower film folded together and an inner film disposed between the upper and the lower films. The inner film and the upper film are adhered to each other by means of hot sealing to form an air filling passageway on the middle position of the upper and the lower films. The inner film and the lower film are adhered to each other to form a buffer room by means of hot sealing on one side of the air filling passageway and thereafter, the upper and the lower films are adhered to each other to form a plurality of air chambers by means of hot sealing respectively at two ends of the air filling passage, and each air chamber is communicated with the air filling passageway. The air in the buffer room thrusts the inner film air filling passageway tightly to cause the air in the air chamber to be unable to flow back to strengthen the airtight function after air filling.

In the structures mentioned above, the two inner films can be attached on one of the outer films, and can also not be attached on any outer film to allow them to be hung in air in the air chamber.

The air-tightness strengthening air enclosure disclosed by the present invention further comprises at least one partitioning line disposed between the air filling passageway and the air chamber. When the partitioning line is loosed to cause the air in the air chamber to be leaked out to the buffer room, the air in the buffer room can then be utilized to press the inner film to shield the air filling passageway to prevent the air from being leaked out via the air filling passageway, not only the cushioning effect can be elevated when the air enclosure is in use, but also the air enclosure life can be effectively extended.

Furthermore, a heat resistant material is spread between the two films according to the present invention, the two inner films are adhered by means of hot sealing to form the air filling passageway, in which the heat resistant material is linear, and the length thereof is shorter than the width of the two inner films so as to form a tunnel type air filling passageway. Besides, the heat resistant material can also be spread in a equidistant way to allow the two inner films not to be adhered to each other to form at least one air entrance even during hot sealing so as to be used for communicating the air filling passageway and the air chamber to form the equidistant nodal air filling passageway.

When the air in the air chamber is leaked out to the buffer room, the air in the buffer room can be utilized to press the inner film to shield the air filling passageway to prevent the air from being leaked out via the air filling passageway, not only the cushioning effect can be elevated when the air enclosure is in use, but also the air enclosure life can be effectively extended.

Besides, a cutting zone is disposed on the air filling passageway according to the present invention, cutting along the cutting zone causes the air chambers at the two ends of the air filling passageway be separated to enable the output of the air enclosures to be doubled.

BRIEF DESCRIPTION OF THE DRAWINGS

The present invention can be more fully understood by reference to the following description and accompanying drawings, in which.

DETAILED DESCRIPTION

Figure 1:
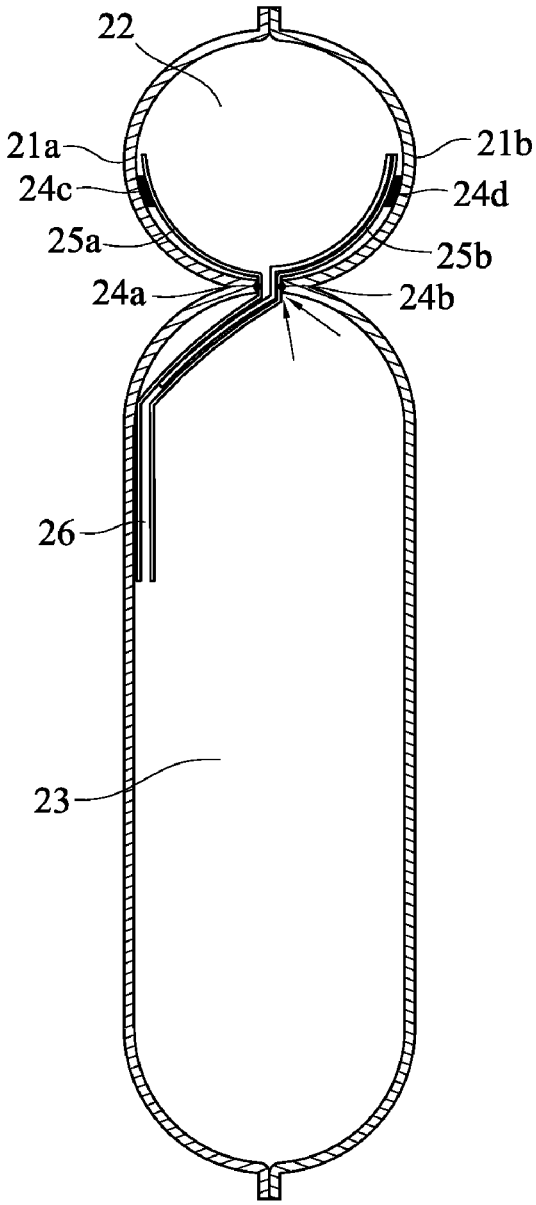
FIG. 1 (PRIOR ART)
FIG. 1 is a schematic view of a conventional air packing bag before air filling.
Figure 2:
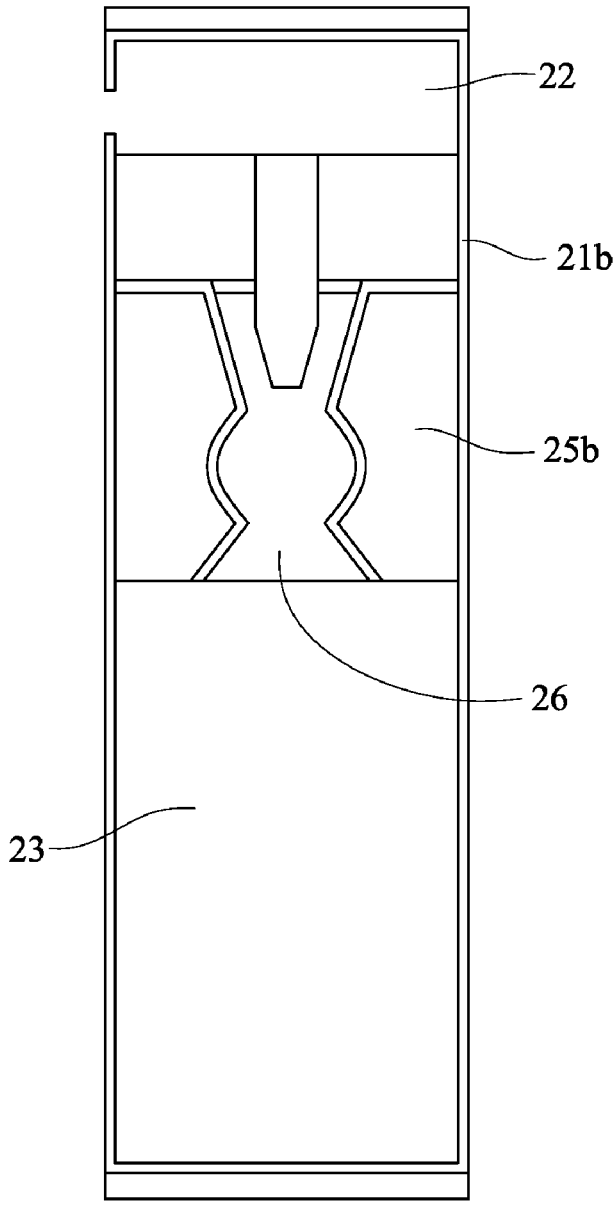
FIG. 2 (PRIOR ART)
FIG. 2 is a cross sectional view of a conventional air packing bag after air filling.
Figure 3A:
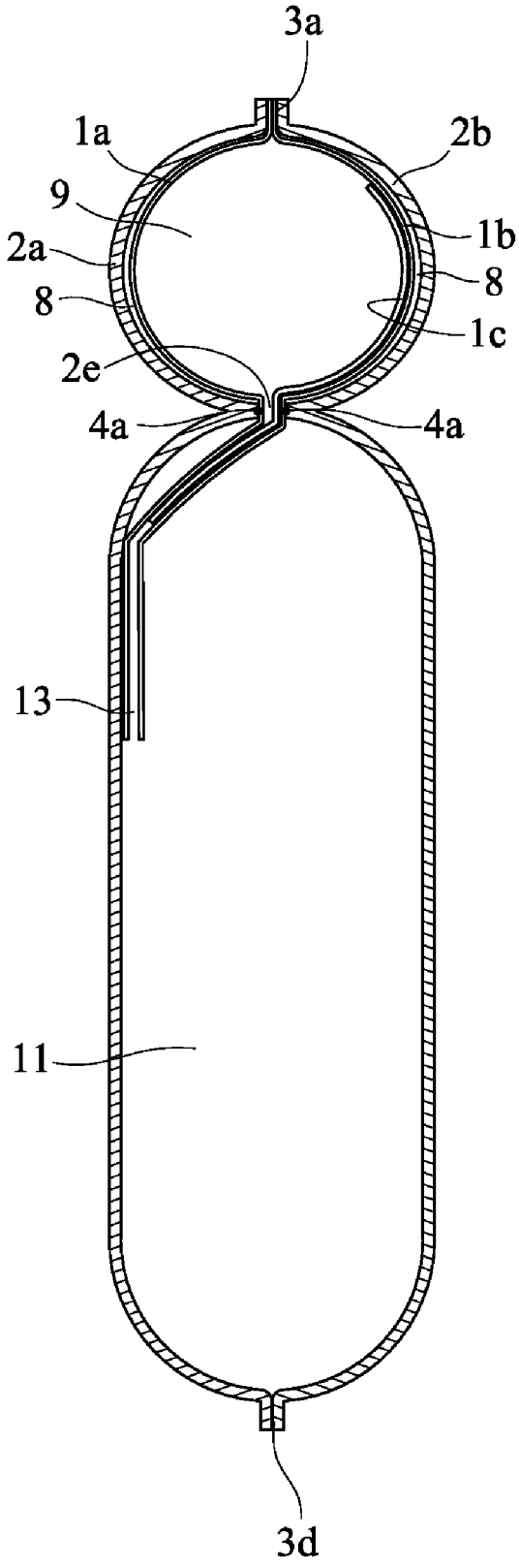
FIG. 3A is a cross sectional view, showing an air enclosure with two sheets attached on a wall after air filling according to the present invention.
Figure 3B:
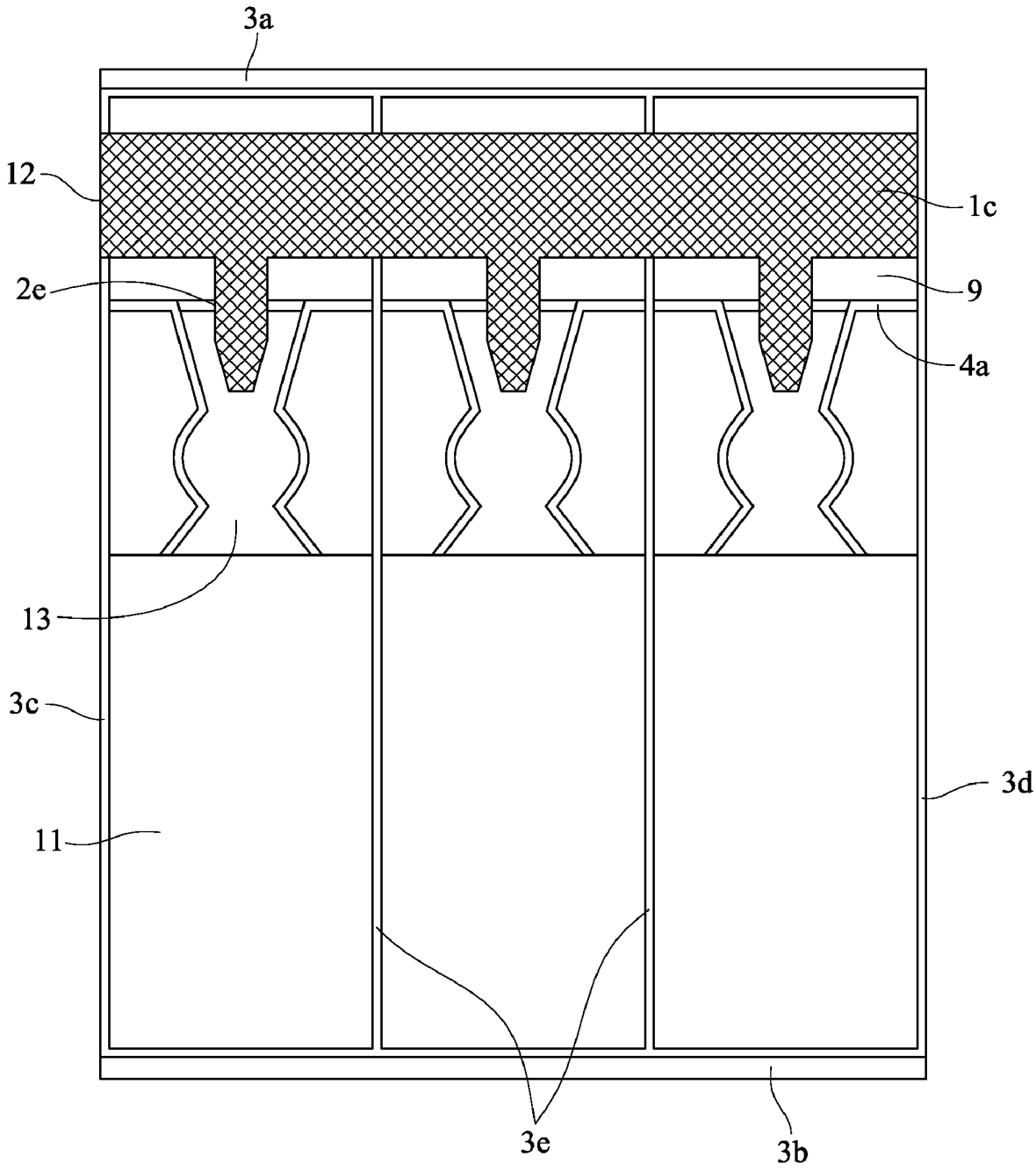
FIG. 3B is a plane view, showing the air enclosure with two sheets attached on a wall before air filling according to the present invention.
Figure 3C:
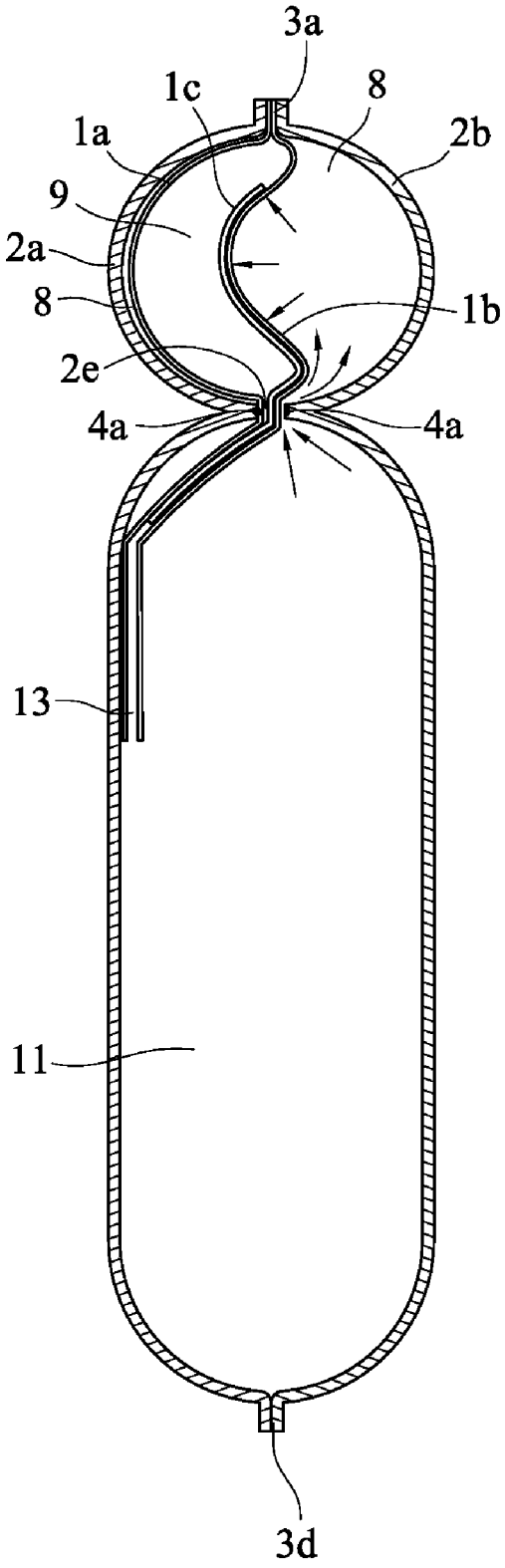
FIG. 3C is a cross sectional view, showing an air chamber of the air enclosure with two sheets attached on a wall in which the air therein is leaked out after air filling according to the present invention.

Please refer to FIGS. 3A, 3B and 3C. FIG. 3A is a cross sectional view, showing an air enclosure with two sheets attached on a wall after air filling according to the present invention. FIG. 3B is a plane view, showing the air enclosure with two sheets attached on a wall before air filling according to the present invention. FIG. 3C is a cross sectional view, showing an air chamber of the air enclosure with two sheets attached on a wall in which the air therein is leaked out after air filling according to the present invention.

An air-tightness strengthening air enclosure comprises two outer films 2*a*, and 2*b*, two inner films 1*a* and 1*b*, air filling passageway 9, air chambers 11 and air passageways 13.

The two outer films 2*a* and 2*b* are folded together vertically.

The two inner films 1*a* and 1*b* are side-attached onto the outer films 2*a* and 2*b*, and a heat resistant material 1*c* is spread between the two inner films 1*a* and 1*b* so as to utilize the heat resistant material 1*c* as an air passable passageway.

Hot sealing is processed along hot sealing lines 3*a*. 3*b*, 3*c*, 3*d* and 3*e* between the upper side and the lower side of the two inner films 1*a* and 1*b* to form a partitioning lines 4*a* and thereby adhere the two outer films 2*a* and 2*b* and the two inner films 1*a* and 1*b* to allow the air passable air filling passageway 9 to be formed between the upper side of the two inner films 1*a* and 1*b* and the partitioning lines 4*a* to enable the air filling passageway 9 to be positioned on one end of the two outer films 2*a* and 2*b*. Furthermore, the air filling passageway 9 is passed through the hot sealing line 3*e* and comprises an air filling entrance 12 communicated with outside air. Here, the hot sealing mentioned above can be hot molding press printing.

After hot sealing is processed, air storable air chambers 11 are enabled to form between the lower side of the two outer films 2*a* and 2*b* as well as the partitioning lines 4*a* and air storable buffer rooms 8 are enabled to form between the upper side of the two outer films 2*a* and 2*b* and the partitioning lines 4*a*.

A heat resistant material 1*c* is spread sequentially and separately between the two inner films 1*a* and 1*b*, e.g. heat resistant rubber or ink is printed. The two inner films 1*a* and 1*b* are still not adhered to each other to form an air passageway 13 and an air inlet 2*e* used for communicating the air filling passageway 9 with the air chamber 11 is formed at the position of the partitioning line 4*a* after hot sealing is processed. Here, the width of one end of the air passageway 13 connected to the air inlet 2*e* is larger than the width of another end thereof, and the air pressure in a curved portion of the air passageway 13 is larger than the air pressure in two sides thereof to allow the air in the first air inlet 2*e* to enter easily and escape out uneasily. The curved portion of the first air passageway 111 is thrust tightly to attain to the air locking effect when the inner air pressure in the air chamber 11 increases.

The air entering the air filling entrance 12 expands the air filling passageway 9 to cause the two inner films 1*a* and 1*b* to be pulled outward to open the air inlet 2*e* and thereby the air in the air filling passageway 9 can be used to fill the air chamber 11 with air to allow the air chamber 11 to be filled with air and expanded. Thus, the inner air pressure of the air chamber 11 presses the two inner films 1*a* and 1*b* to attach closely onto the outer film 2*a* or 2*b* to cover the air passageway 13 and hence, seal the air chamber 11. Whereby, the air is allowed not to be leaked out thereby attaining to the air locking effect.

The inner air pressure of the air chamber 11 causes the partitioning line 4*a* to be gradually loosed to cause the air in the air chamber 11 to flow through a gap of the partitioning line 4*a* to be leaked out. The inner air pressure of the buffer room 8 presses the two inner films 1*a* and 1*b* to shield the air filling passageway 9 to prevent the air from being leaked out through the air filling passageway 9 after the air in the air chamber 11 is leaked out to the buffer room 8. Whereby, not only the cushioning effect of the air enclosure in use can be elevated, but also the air enclosure life can be effectively extended.

Figure 4A:
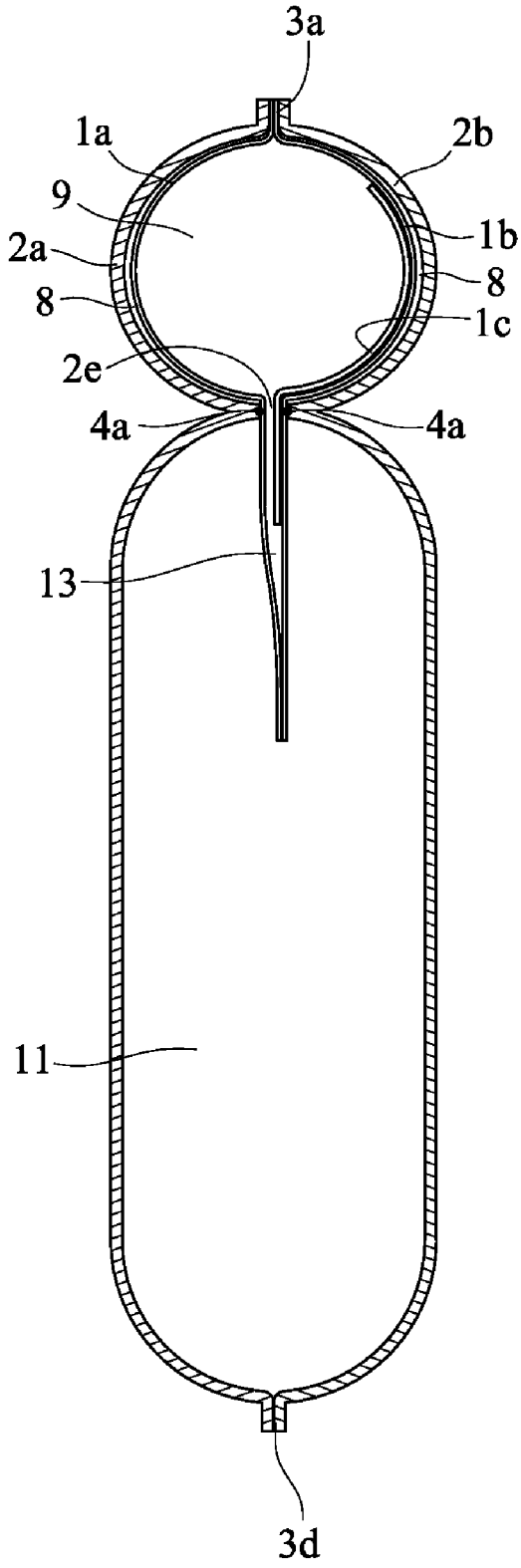
FIG. 4A is a cross sectional view, showing an air enclosure with two sheets hung in air after air filling according to the present invention.
Figure 4B:
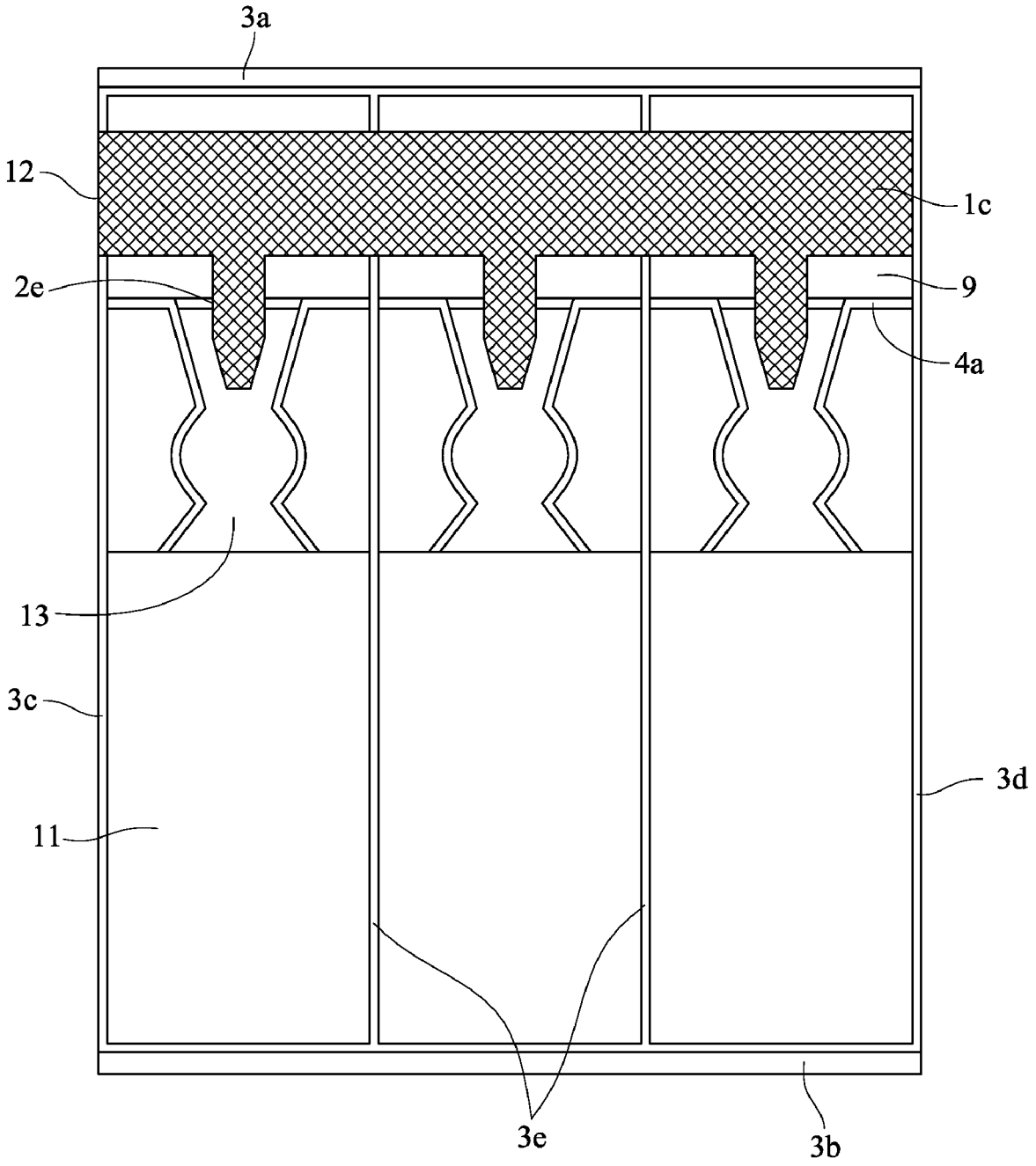
FIG. 4B is a plane view, showing the air enclosure with two sheets hung in air before air filling according to the present invention.
Figure 4C:
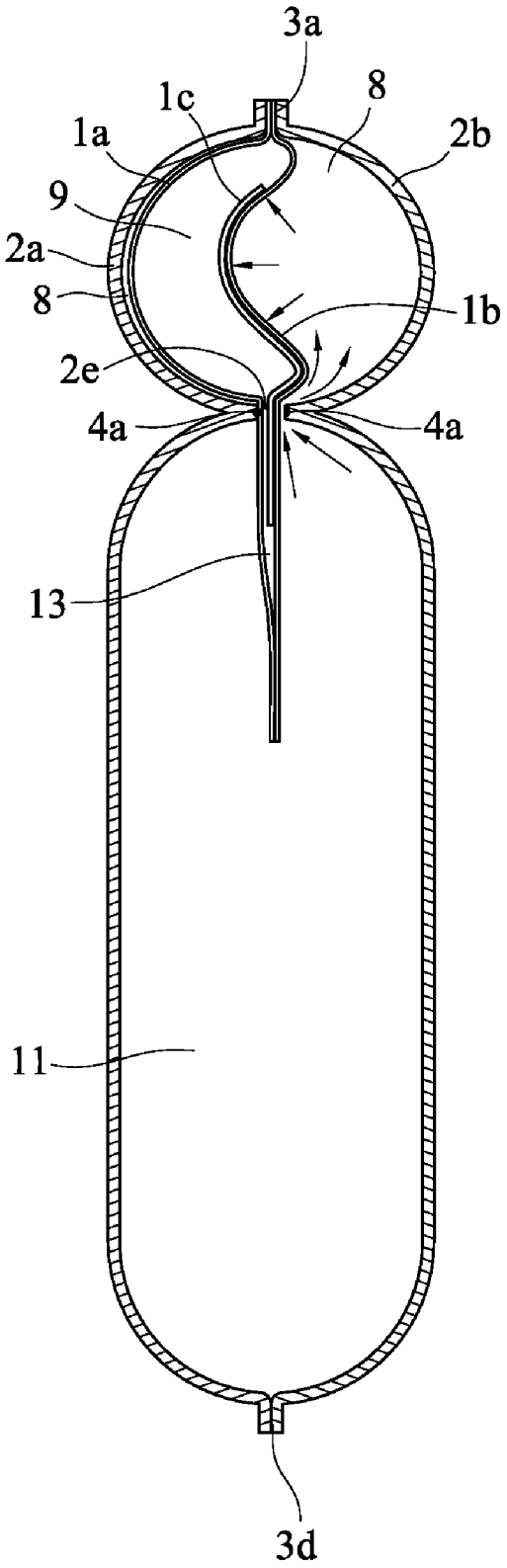
FIG. 4C is a cross sectional view, showing an air chamber of the air enclosure with two sheets hung in air in which the air therein is leaked out after air filling according to the present invention.

Please refer to FIGS. 4A, 4B and 4C. FIG. 4A is a cross sectional view, showing an air enclosure with two sheets hung in air after air filling according to the present invention. FIG. 4B is a plane view, showing the air enclosure with two sheets hung in air before air filling according to the present invention. FIG. 4C is a cross sectional view, showing an air chamber of the air enclosure with two sheets hung in air in which the air therein is leaked out after air filling according to the present invention;

The two inner films 1*a* and 1*b* are disposed between the two outer films 2*a* and 2*b*, and the two inner films 1*a* and 1*b* are not side-attached onto the outer film 2*a* or 2*b* but hung in air; the air enclosure becomes a two-sheets cantilever type air enclosure. Almost all structures here are the same as the two-sheets wall-attached type air enclosure except the two inner films 1*a* and 1*b* are not side-attached onto the outer film 2*a* or 2*b*.

The upper sides of the two inner films 1*a* and 1*b* and the upper sides of the two outer films 2*a* and 2*b* mentioned above can respectively be adhered to each other by means of hot sealing to enable a buffer room to be formed between the two inner films 1*a* and 1*b* and the two outer films 2*a* and 2*b*, the upper sides of the two inner films 1*a* and 1*b* and the upper sides of the two outer films 2*a* and 2*b* are arranged to line up with one another and in the meantime, the two inner films 1*a* and 1*b* and the two outer films 2*a* and 2*b* are adhered to each other by means of hot sealing to enable two buffer rooms 8 to be formed between the two inner films 1*a* and 1*b* and the two outer films 2*a* and 2*b*.

Furthermore, the two outer films 2*a* and 2*b* can be adhered to each other equidistantly by hot sealing to form the plurality of air chambers 11 with the same size and can also be adhered to each other non-equidistantly to form the plurality of air chambers 11 with different size.

Figure 5A:
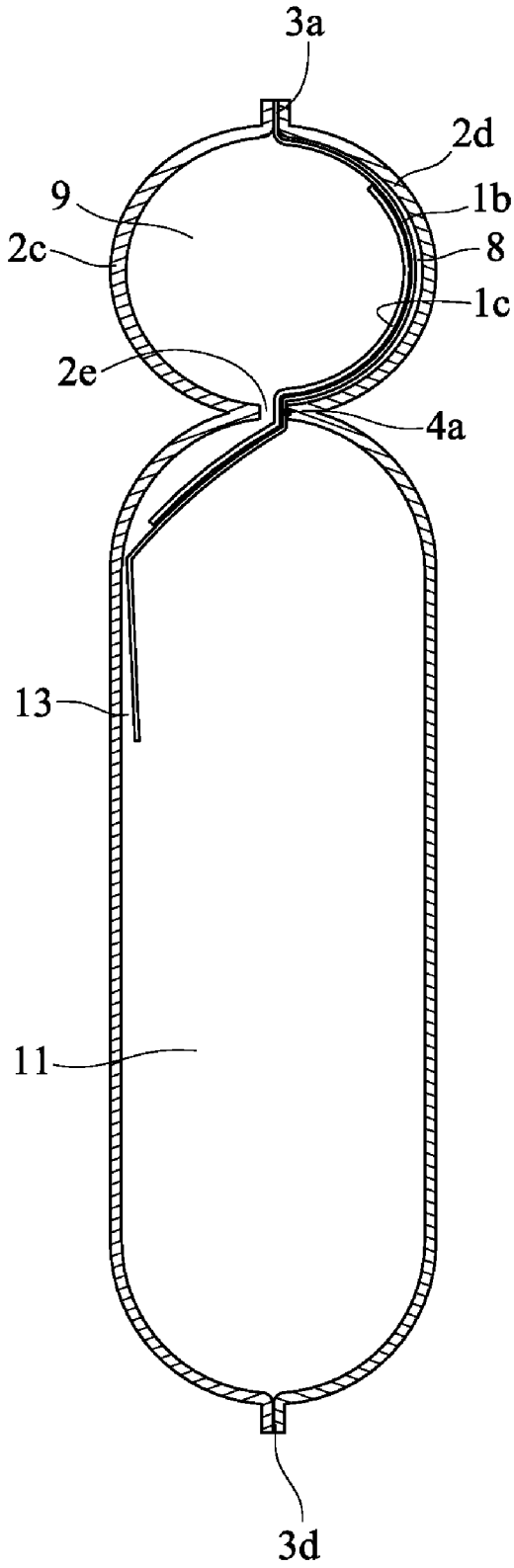
FIG. 5A is a cross sectional view, showing an air enclosure with one sheet attached on a wall after air filling according to the present invention.
Figure 5B:
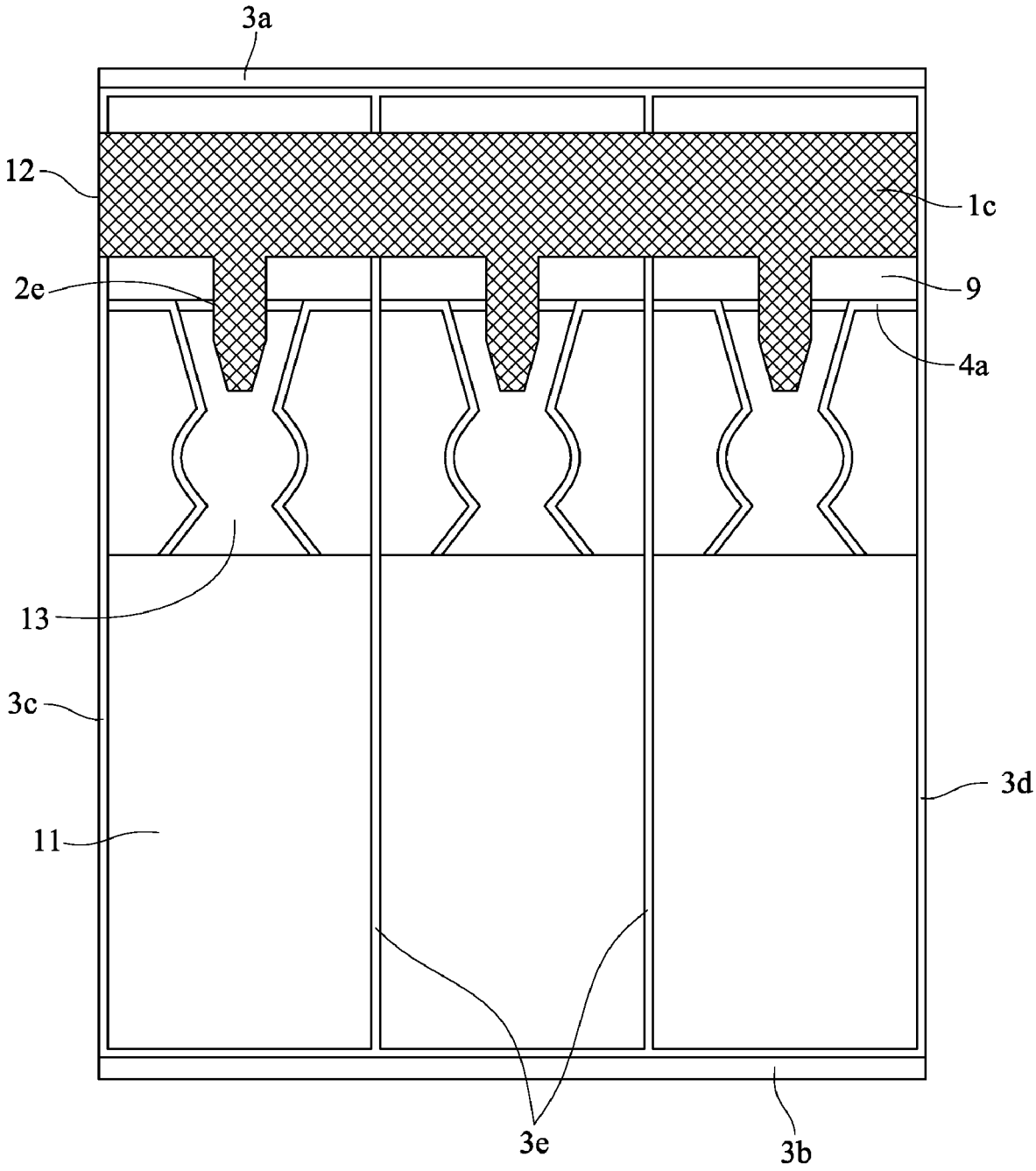
FIG. 5B is a plane view, showing the air enclosure with one sheet attached on a wall before air filling according to the present invention.
Figure 5C:
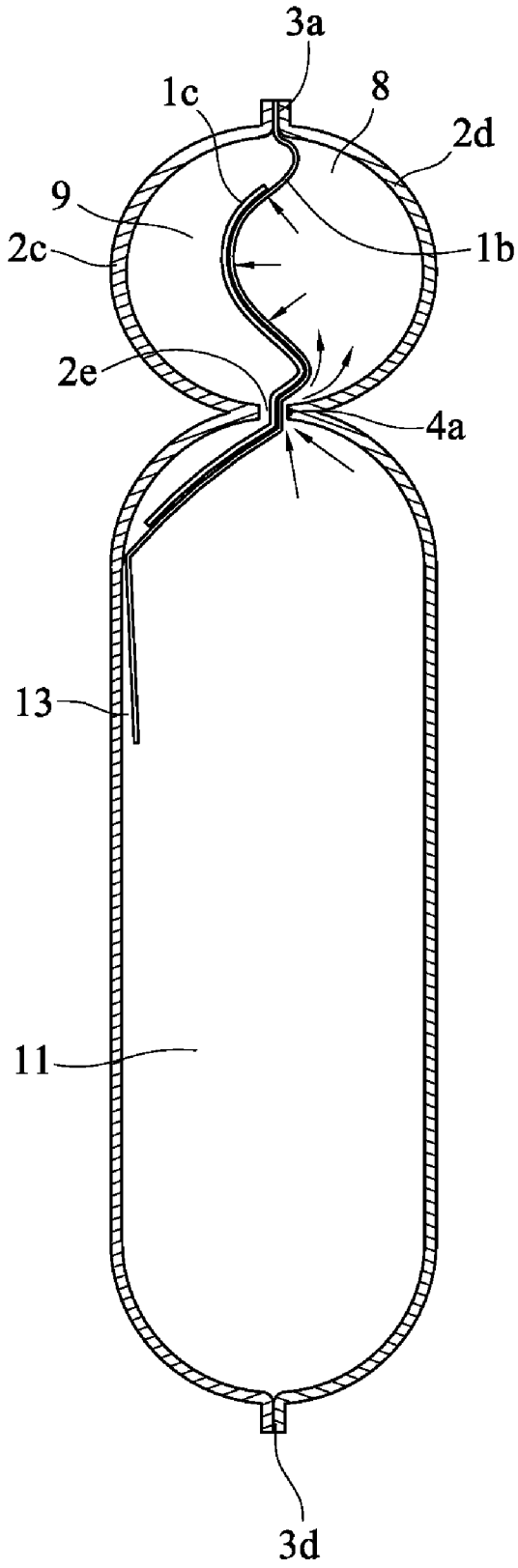
FIG. 5C is a cross sectional view, showing an air chamber of the air enclosure with one sheet attached on a wall in which the air therein is leaked out after air filling according to the present invention.

Please refer to FIGS. 5A, 5B and 5C. FIG. 5A is a cross sectional view, showing an air enclosure with one sheet attached on a wall after air filling according to the present invention. FIG. 5B is a plane view, showing the air enclosure with one sheet attached on a wall before air filling according to the present invention. FIG. 5C is a cross sectional view, showing an air chamber of the air enclosure with one sheet attached on a wall in which the air therein is leaked out after air filling according to the present invention.

An air-tightness strengthening air enclosure comprises a upper film 2*c*, a lower film 2*d*, an inner film 1*b*, air filling passageway 9, air chambers 11 and air passageways 13.

The upper and the lower films 2*c* and 2*d* are folded together vertically.

The inner film 1*b* is disposed between the upper and the lower films 2*c* and 2*d*, the upper side of the inner film 1*b* is lined up with the upper side of the upper film 2*c*, and a heat resistant material 1*c* is spread between the inner film 1*b* and the upper film 2*c* so as to utilize the heat resistant material 1*c* as an air passable passageway.

Hot sealing is processed along hot sealing lines 3*a*. 3*b*, 3*c*, 3*d* and 3*e* between the upper side and the lower side of the inner film 1*b* to form partitioning lines 4*a* and thereby adhere the inner film 1*b*, the upper film 2*a* and the lower film 2*b* together to allow the air passable air filling passageway 9 to be formed between the upper side of the upper film 2*c* and the partitioning lines 4*a*. Furthermore, the air filling passageway 9 is passed through the hot sealing line 3*e* and comprises an air filling entrance 12 communicated with outside air. Here, the hot sealing mentioned above can be hot molding press printing.

After hot sealing is processed, air storable air chambers 11 are enabled to form between the lower side of the upper and lower films 2*c* and 2*d* as well as the partitioning lines 4*a* and air storable buffer rooms 8 are enabled to form between the upper side of the upper and the lower films 2*c* and 2*d* and the partitioning lines 4*a*.

A heat resistant material 1*c* is spread sequentially and separately between the inner film 1*b* and the upper film 2*c*, e.g. heat resistant rubber or ink is printed. The inner film 1*b* and the upper film 2*c* are still not adhered to each other to form an air passageway 13 and an air inlet 2*e* is formed at one end of the air passageway 13 after hot sealing. Here, the width of one end of the air passageway 13 connected to the air inlet 2*e* is larger than the width of another end thereof, and the air pressure in a curved portion of the air passageway 13 is larger than the air pressure in two sides thereof to allow the air in the first air inlet 2*e* to enter easily and escape out uneasily. The curved portion of the air passageway 13 is thrust tightly to attain to the air locking effect when the inner air pressure in the air chamber 11 increases.

The air entering the air filling entrance 12 expands the air filling passageway 9 to cause the inner film 1*b* and the upper film 2*c* to be pulled outward to open the air inlet 2*e* and thereby the air in the air filling passageway 9 can be used to fill the air chamber 11 with air to allow the air chamber 11 to be filled with air and expanded. Thus, the inner air pressure of the air chamber 11 presses the inner film 1*b* to attach closely onto the upper film 2*c* to cover the air passageway 13 and hence, seal the air chamber 11. Whereby, the air is allowed not to be leaked out thereby attaining to the air locking effect.

The inner air pressure of the air chamber 11 causes the partitioning line 4*a* to be gradually loosed to cause the air in the air chamber 11 to flow through a gap of the partitioning line 4*a* to be leaked out. The inner air pressure of the buffer room 8 presses the inner film 1*b* to attach closely onto the upper film 2*c* to shield the air filling passageway 9 to prevent the air from being leaked out through the air filling passageway 9 after the air in the air chamber 11 is leaked out to the buffer room 8. Whereby, not only the cushioning effect of the air enclosure in use can be elevated, but also the air enclosure life can be effectively extended.

The upper and the lower films 2*c* and 2*d* mentioned above can be adhered to each other equidistantly by hot sealing to form the plurality of air chambers 11 with the same size and can also be adhered to each other non-equidistantly to form the plurality of air chambers 11 with different size. Furthermore, the air passageway 13 can be a hot sealing curved line type, multiple dots type, double curve type or straight line type air progressing route. Furthermore, it is hereby explained that although the description mentioned above takes that the air storable air chambers 11 are formed at one end of the air filling passageway 9 by the upper film 2*c* and the lower film 2*d*, the air storable air chambers 11 can respectively be formed at two end of the air filling passageway 9 by the upper film 2*c* and the lower film 2*d*.

Figure 6A:
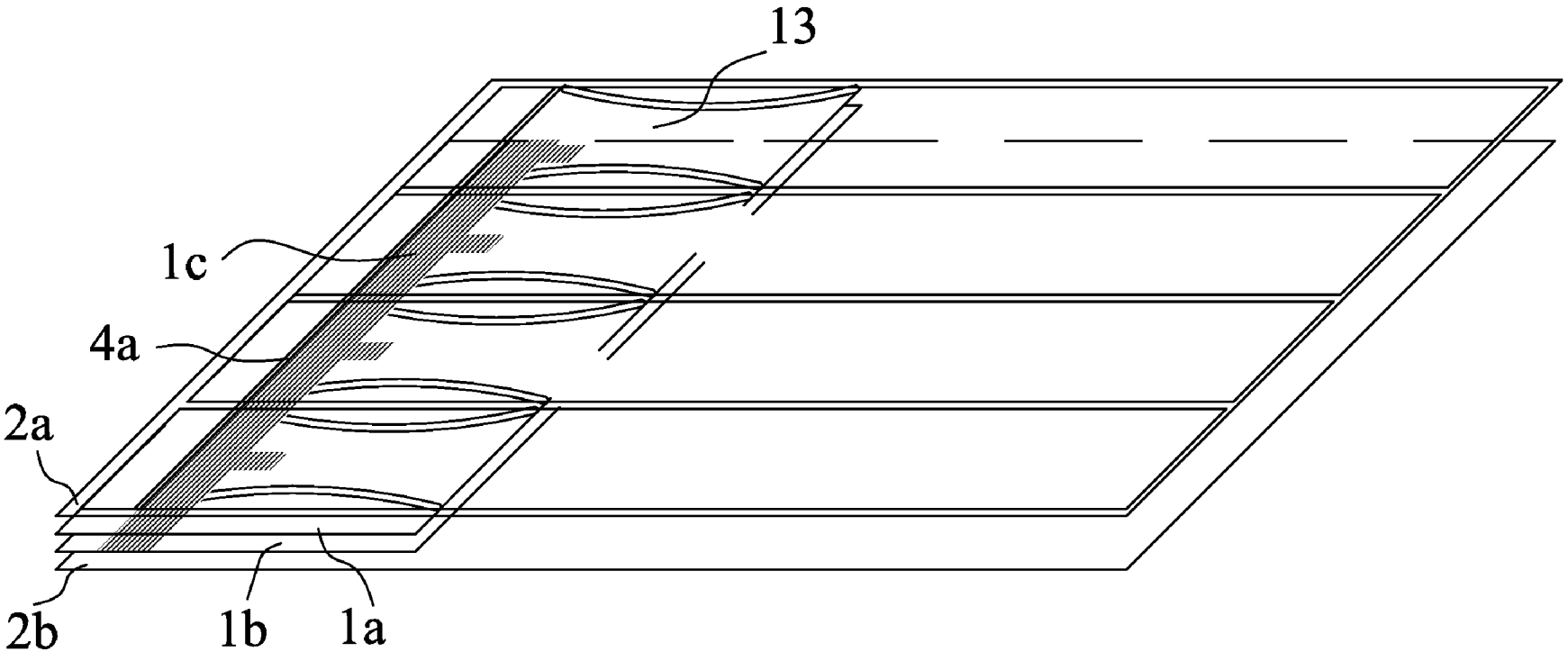
FIG. 6A is a schematic view, showing a tunnel type single-directional air filling air enclosure before air filling according to the present invention.
Figure 6B:
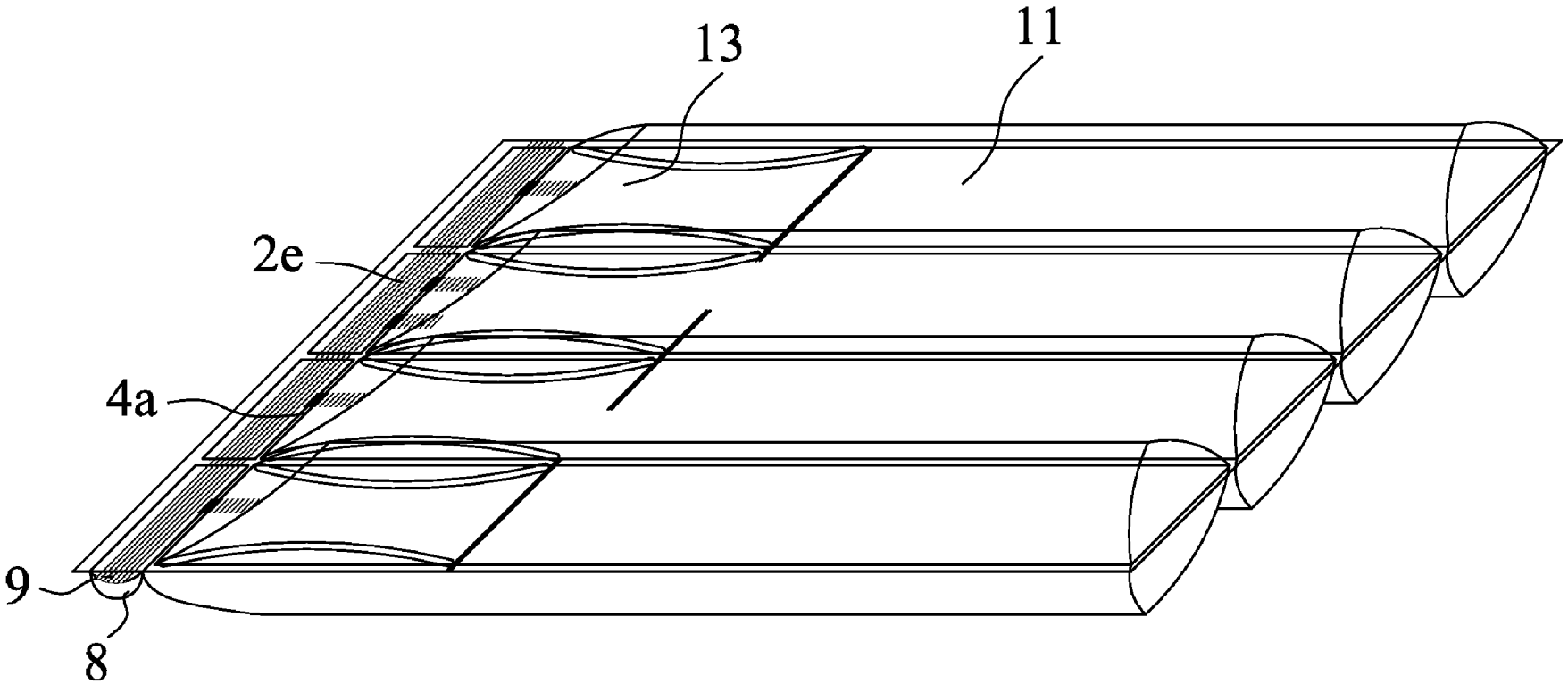
FIG. 6B is a schematic view, showing a tunnel type single-directional air filling air enclosure after air filling according to the present invention.

Please refer to FIGS. 6A and 6B. FIG. 6A is a schematic view, showing a tunnel type single-directional air filling air enclosure before air filling according to the present invention. FIG. 6B is a schematic view, showing a tunnel type single-directional air filling air enclosure after air filling according to the present invention.

A linear heat resistant material 1*c* is spread on one end of the inner surfaces of two inner films 1*a* and 1*b*, the width thereof is approximately 1 centimeter and the length thereof is approximately equal to the width of the two outer films 2*a* and 2*b*. A tunnel type air filling passageway 9 is formed after hot sealing is processed, and two inner films 1*a* and 1*b* are adhered to each other by means of hot sealing to form an air inlet 2*e* used for communicating the air filling passageway 9 and an air chamber 11, and a partitioning line 4*a* is formed by means of hot sealing between the air filling passageway 9 and the air chambers 11. Air flows through the air inlet and enters each air chamber 11 along the tunnel type air filling passageway 9 via an air filling entrance 12 when air is filled to cause the air chambers 11 to be filled with air and expanded at one side of the partitioning line 4*a*. Thereafter, the inner air pressure of the air chamber 11 presses the two inner films 1*a* and 1*b* to form the air locking to allow the air enclosure to be airtight. If the partitioning line 4*a* is loosed, the air in the air chamber 11 is passed through the partitioning 4*a* and flows into a buffer room 8. Further, the inner air pressure of the buffer room 8 will press the two inner films 1*a* and 1*b* and further to shield the tunnel type air filling passageway 9 and the air inlet 2*e* and thereby be taken as a second line of defense for preventing the air of the air enclosure from being leaked out.

Figure 6C:
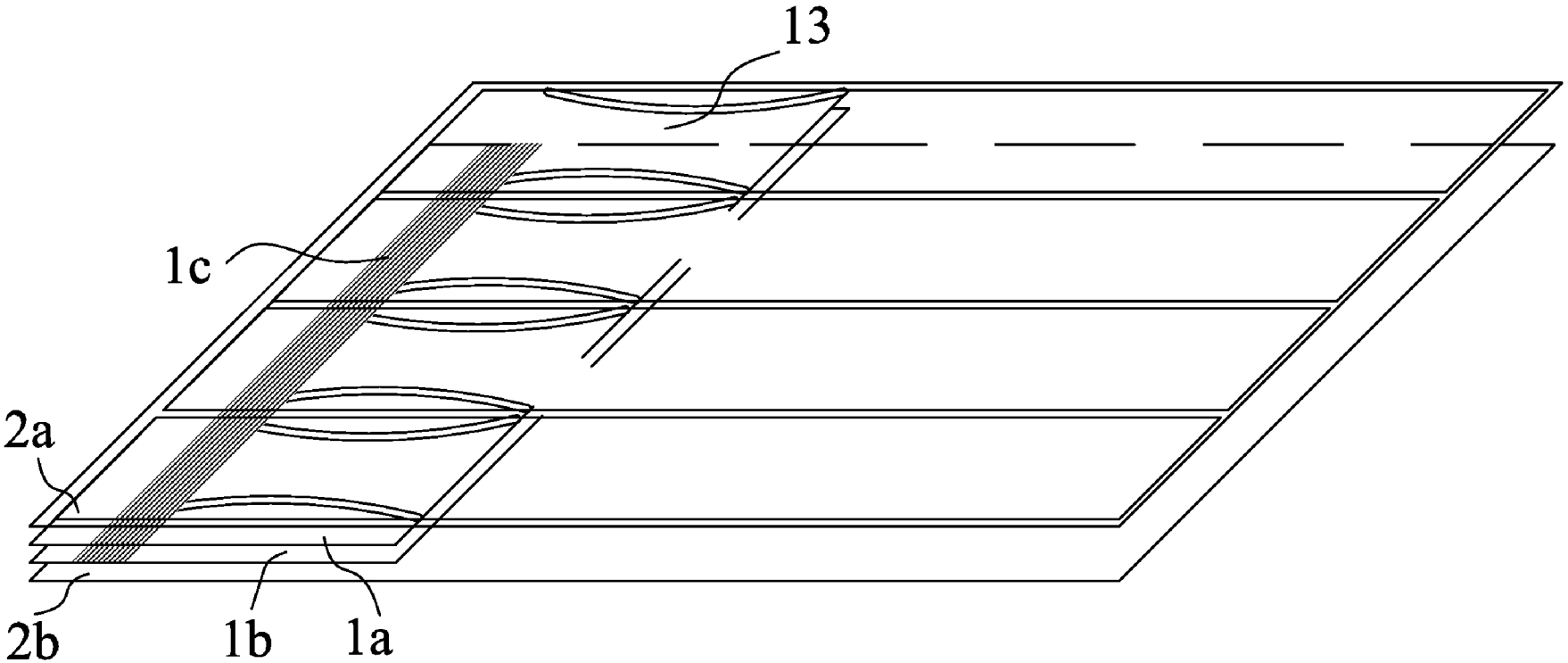
FIG. 6C is a schematic view, showing another tunnel type single-directional air filling air enclosure before air filling according to the present invention.
Figure 6D:
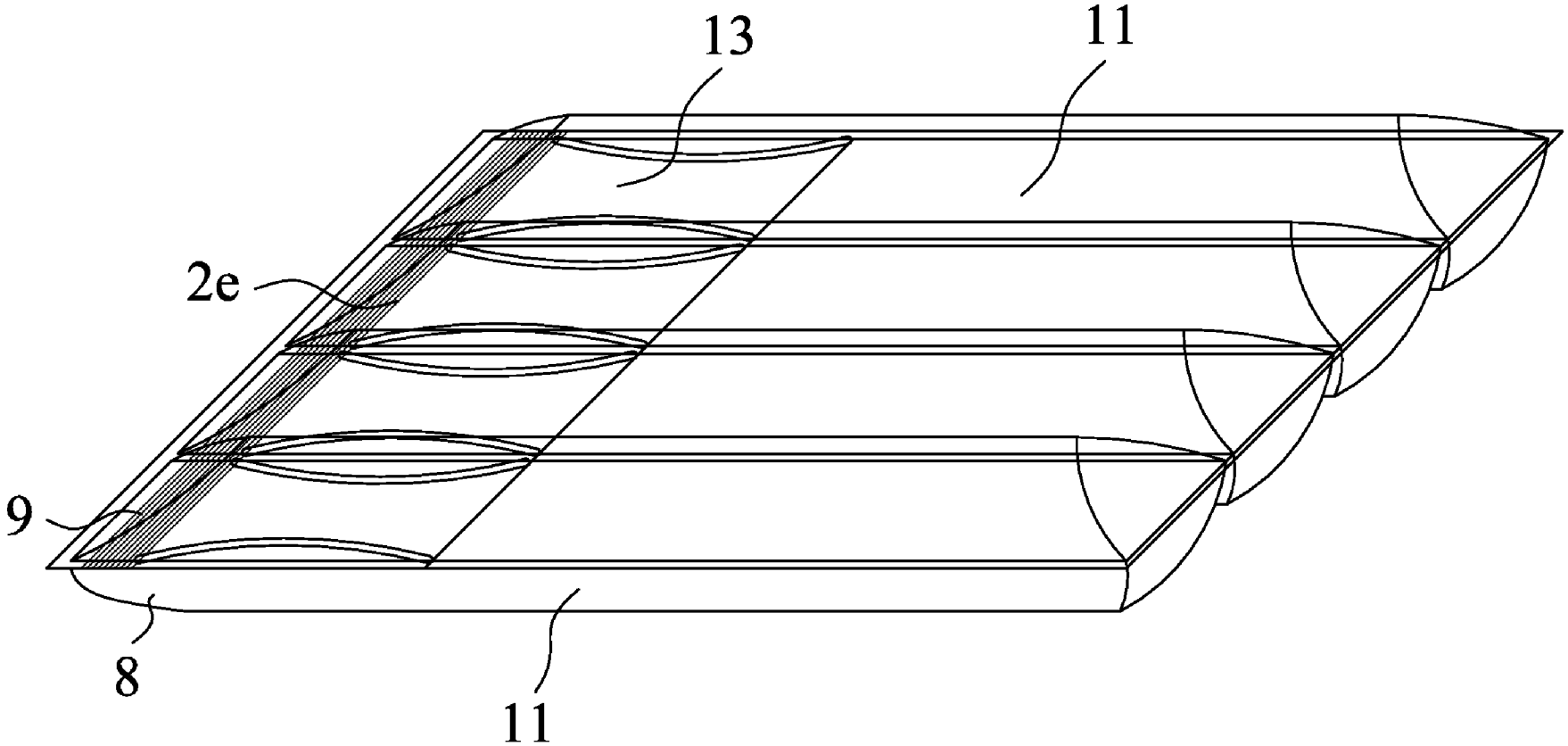
FIG. 6D is a schematic view, showing another tunnel type single-directional air filling air enclosure after air filling according to the present invention.

Please refer to FIGS. 6C and 6D. FIG. 6C is a schematic view, showing another tunnel type single-directional air filling air enclosure before air filling according to the present invention. FIG. 6D is a schematic view, showing another tunnel type single-directional air filling air enclosure after air filling according to the present invention.

A linear heat resistant material 1*c* is spread on one end of the inner surfaces of two inner films 1*a* and 1*b*, the width thereof is approximately 1 centimeter and the length thereof is approximately equal to the width of the two outer films 2*a* and 2*b*. A tunnel type air filling passageway 9 is formed after hot sealing is processed. Air flows through the air inlet 2*e* and enters each air chamber 11 along the tunnel type air filling passageway 9 via an air filling entrance 12 when air is filled and flows into a buffer room 8 via the air chamber 11 to cause the air chamber 11 and the buffer room 8 to be filled with air and expanded. Further, the air of the air chamber 11 and the buffer room 8 press the two inner films 1*a* and 1*b* to form the air locking and further to shield the tunnel type air filling passageway 9 and the air inlet 2*e* and thereby cause the air in the air chamber 11 to be unable to flow back and strengthen the air-tightness function.

Figure 7A:
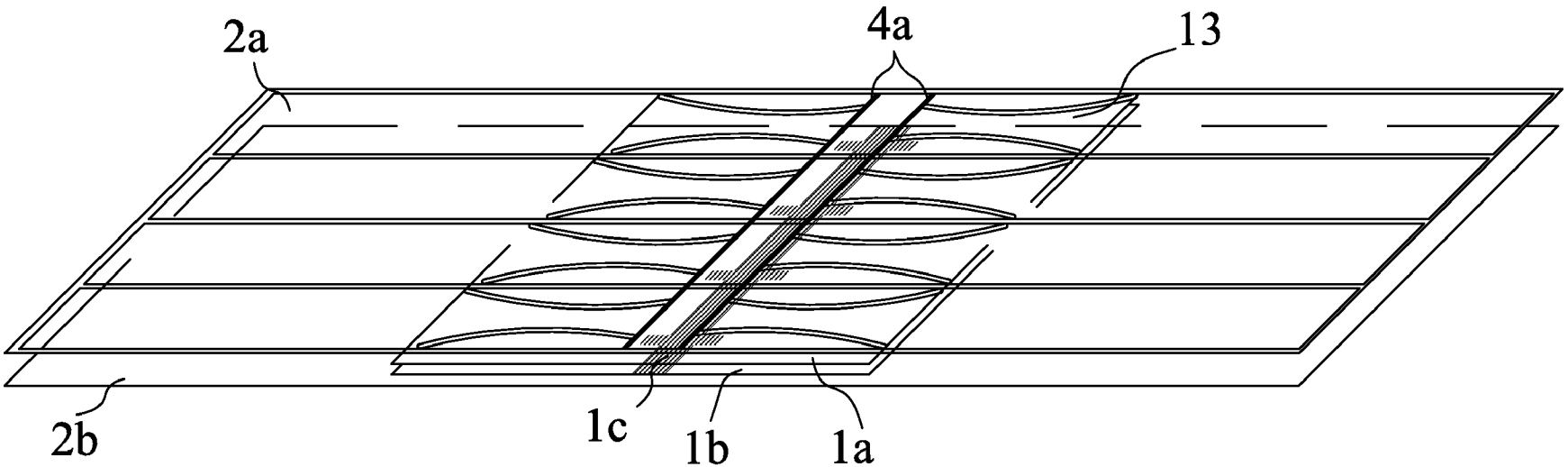
FIG. 7A is a schematic view, showing a tunnel type double-directional air filling air enclosure before air filling according to the present invention.
Figure 7B:
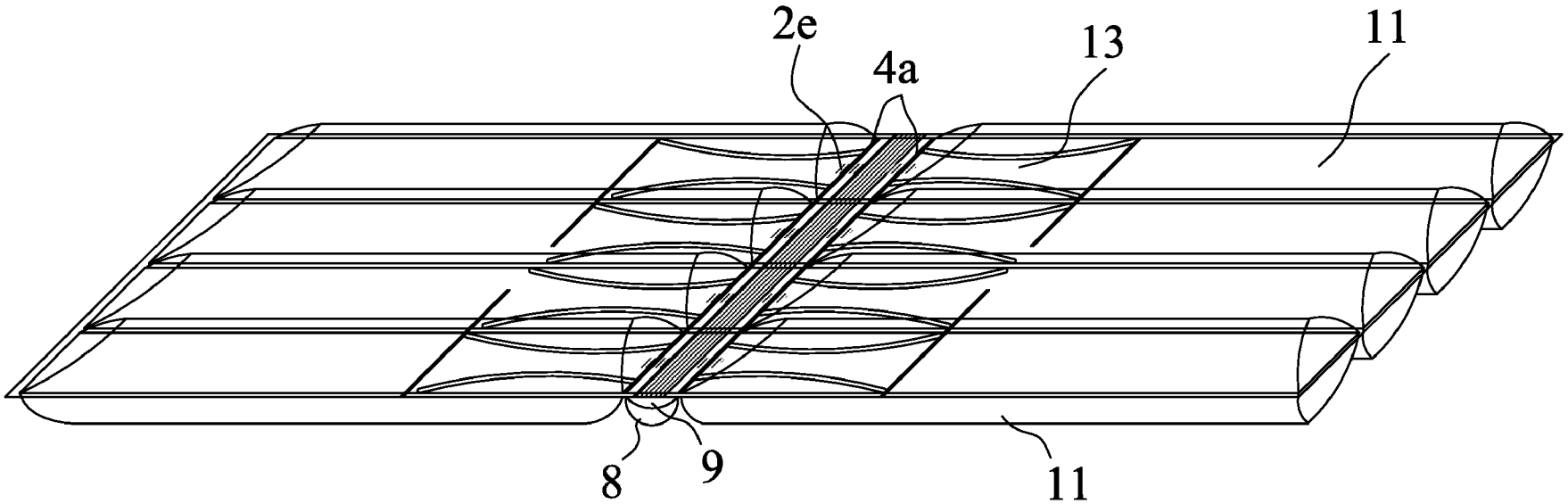
FIG. 7B is a schematic view, showing a tunnel type double-directional air filling air enclosure after air filling according to the present invention.

Please refer to FIGS. 7A and 7B. FIG. 7A is a schematic view, showing a tunnel type double-directional air filling air enclosure before air filling according to the present invention. FIG. 7B is a schematic view, showing a tunnel type double-directional air filling air enclosure after air filling according to the present invention.

A linear heat resistant material 1*c* is spread on the inner surfaces of two inner films 1*a* and 1*b*, the width thereof is approximately 1 centimeter and the length thereof is approximately equal to the width of the two outer films 2*a* and 2*b*. A tunnel type air filling passageway 9 is formed after hot sealing is processed to allow the tunnel type air filling passageway 9 to be positioned in the middle of the two outer films 2*a* and 2*b*; a plurality of air chambers 11 are formed at two ends of the tunnel type air filling passageway 9. Furthermore, the air chambers 11 at the two ends of the air filling passageway 9 are independent and not communicated with one another, partitioning lines 4*a* are formed by hot sealing between the air filling passageway 9 and the air chambers 11. Air flows through the air inlet 2*e* and enters each air chamber 11 along the tunnel type air filling passageway 9 via an air filling entrance 12 when air is filled to cause the air chambers 11 to be filled with air and expanded at one side of the partitioning line 4*a*. Thereafter, the inner air pressure of the air chamber 11 presses the two inner films 1*a* and 1*b* to form the air locking to allow the air enclosure to be airtight. If the partitioning line 4*a* is loosed, the air in the air chamber 11 is passed through the partitioning line 4*a* and flows into a buffer room 8. Further, the inner air pressure of the buffer room 8 will press the two inner films 1*a* and 1*b* and further to shield the tunnel type air filling passageway 9 and the air inlet 2*e* and thereby be taken as a second line of defense for preventing the air of the air enclosure from being leaked out. Furthermore, the air in the air filling passageway 9 is filled into the air chambers 11 at the two ends simultaneously; it can attain to the air filling time shortening purpose.

Figure 7C:
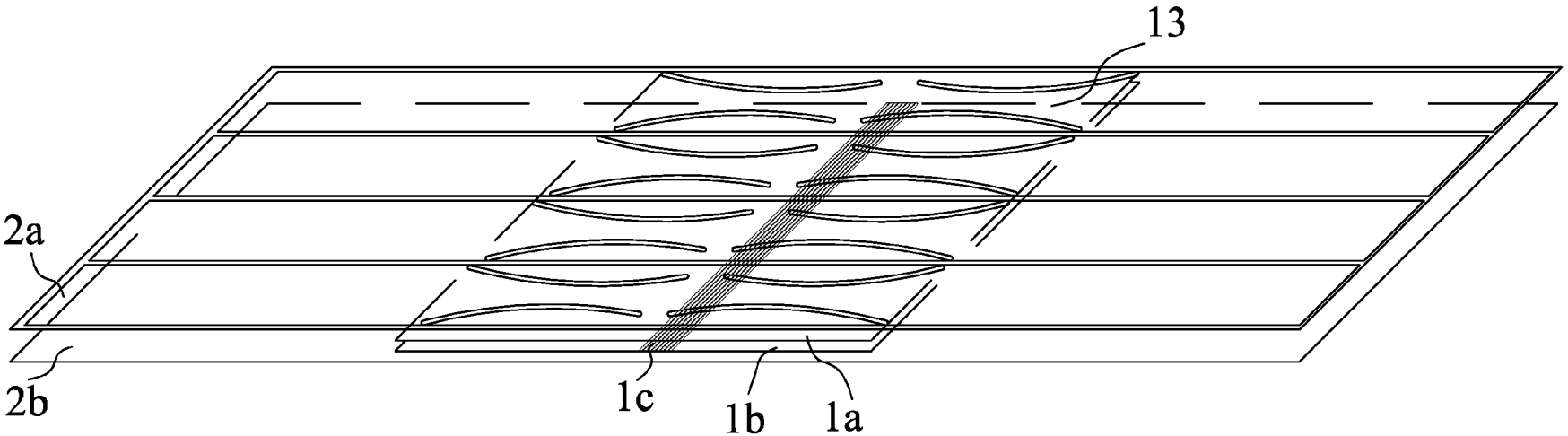
FIG. 7C is a schematic view, showing another tunnel type double-directional air filling air enclosure before air filling according to the present invention.
Figure 7D:
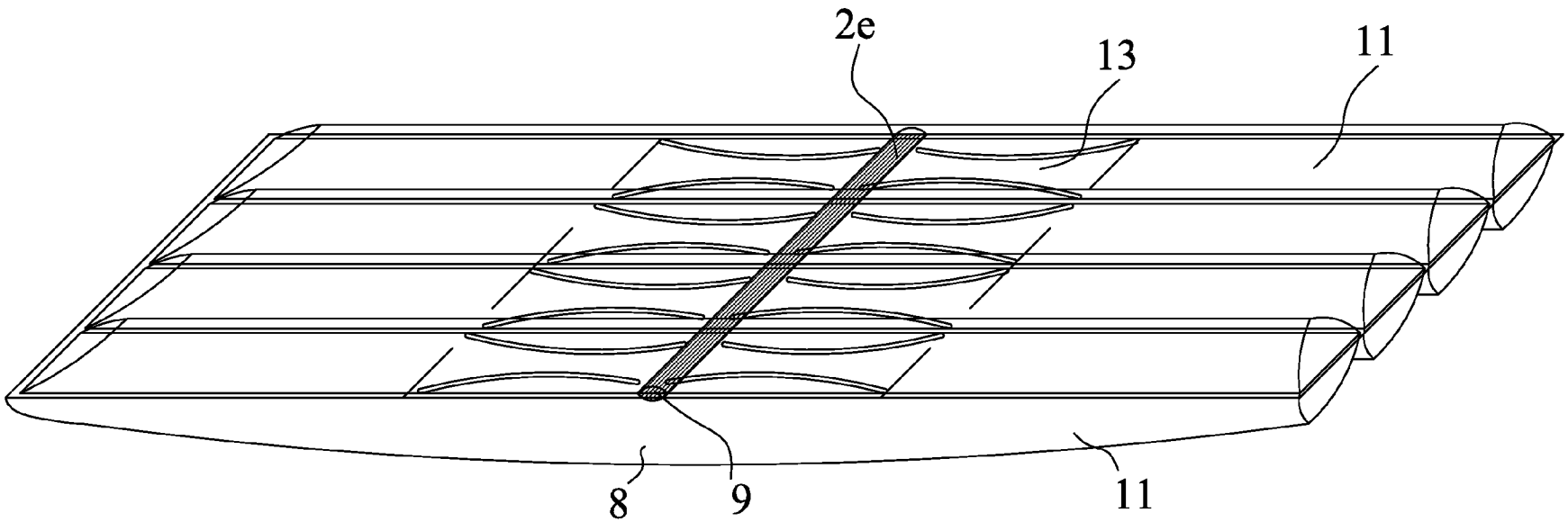
FIG. 7D is a schematic view, showing another tunnel type double-directional air filling air enclosure after air filling according to the present invention.

Please refer to FIGS. 7C and 7D. FIG. 7C is a schematic view, showing another tunnel type double-directional air filling air enclosure before air filling according to the present invention. FIG. 7D is a schematic view, showing another tunnel type double-directional air filling air enclosure after air filling according to the present invention.

A linear heat resistant material 1*c* is spread on the inner surfaces of two inner films 1*a* and 1*b*, the width thereof is approximately 1 centimeter and the length thereof is approximately equal to the width of the two outer films 2*a* and 2*b*. A tunnel type air filling passageway 9 is formed after hot sealing is processed to allow the tunnel type air filling passageway 9 to be positioned in the middle of the two outer films 2*a* and 2*b*; a plurality of air chambers 11 are formed at two ends of the tunnel type air filling tunnel 9. Air flows through the air inlet and enters each air chamber 11 along the tunnel type air filling passageway 9 via an air filling entrance 12 when air is filled and flows into a buffer room 8 via the air chamber 11 to cause the air chamber 11 and the buffer room 8 to be filled with air and expanded. Further, the air of the air chamber 11 and the buffer room 8 press the two inner films 1*a* and 1*b* to form the air locking and further to shield the tunnel type air filling passageway 9 and the air inlet 2*e* and thereby cause the air in the air chamber 11 to be unable to flow back and strengthen the air-tightness function. Furthermore, the air in the air filling passageway 9 is filled into the air chambers 11 at the two ends simultaneously; it can attain to the air filling time shortening purpose.

Figure 8A:
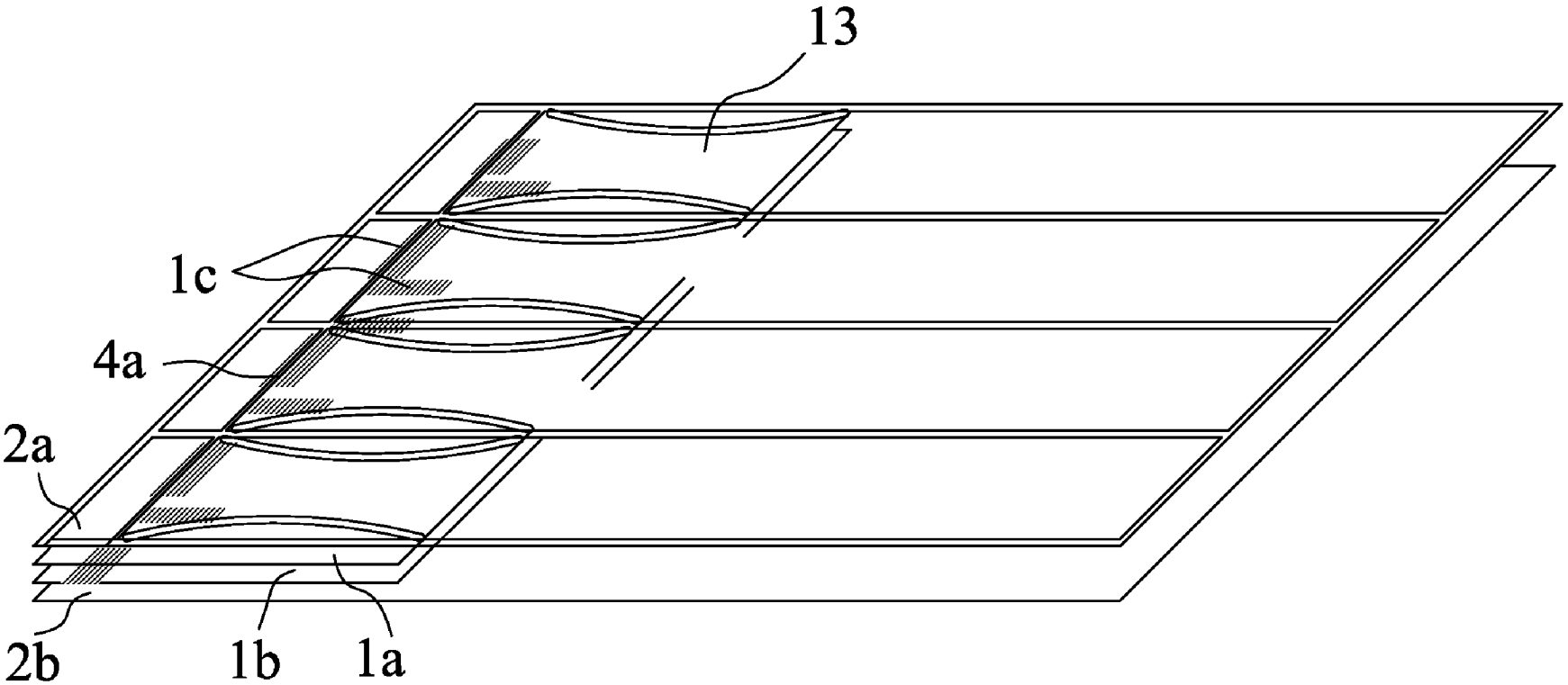
FIG. 8A is a schematic view, showing a nodal single-directional air filling air enclosure before air filling according to the present invention.
Figure 8B:
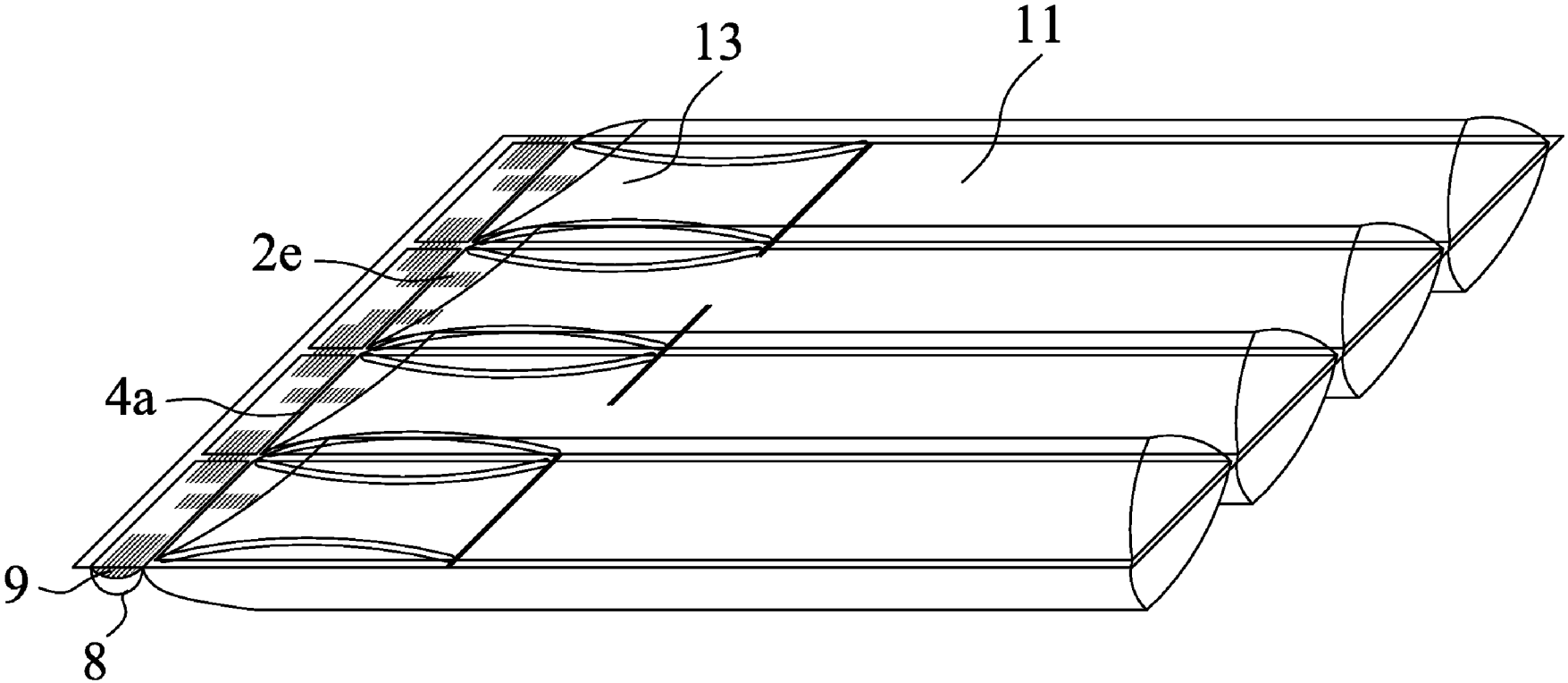
FIG. 8B is a schematic view, showing a nodal single-directional air filling air enclosure after air filling according to the present invention.

Please refer to FIGS. 8A and 8B. FIG. 8A is a schematic view, showing a nodal single-directional air filling air enclosure before air filling according to the present invention. FIG. 8B is a schematic view, showing a nodal single-directional air filling air enclosure after air filling according to the present invention.

A heat resistant material 1*c* is spread on the positions that hot sealing lines 3*e* are passed through an air filling passageway 9 at the inner surface of two inner films 1*a* and 1*b*, and the heat resistant material 1*c* is spread equidistantly with length approximately 1.2 centimeters and width approximately 1 centimeter. Thereafter, the two inner films 1*a* and 1*b* are not adhered to each other even by means of hot sealing to form air inlets 2*e* so as to utilize the air inlet 2*e* to communicate the air filling passageway 9 with air chambers 11. Besides, a partitioning line 4*a* is formed by means of hot sealing between the air filling passageway 9 and the air chambers 11.

Air flows along the air filling passageway 9 to sequentially open the air inlet 2*e* of each air chamber 11 when air is filled and then enters each air chamber 11 according to a preset air progressing route to cause the air chambers 11 at the side of the partitioning line 4*a* to be filled with air and expanded. Thereafter, the inner air pressure of the air chamber 11 presses the two inner films 1*a* and 1*b* to form the air locking to enable the air enclosure to be airtight. If the partitioning line 4*a* is loosed, the air in the air chamber 11 is passed through the partitioning line 4*a* and flows into a buffer room 8. Further, the inner air pressure of the buffer room 8 will press the two inner films 1*a* and 1*b* and further to shield the tunnel type air filling passageway 9 and the air inlet 2*e* to form the air sealing.

Figure 8C:
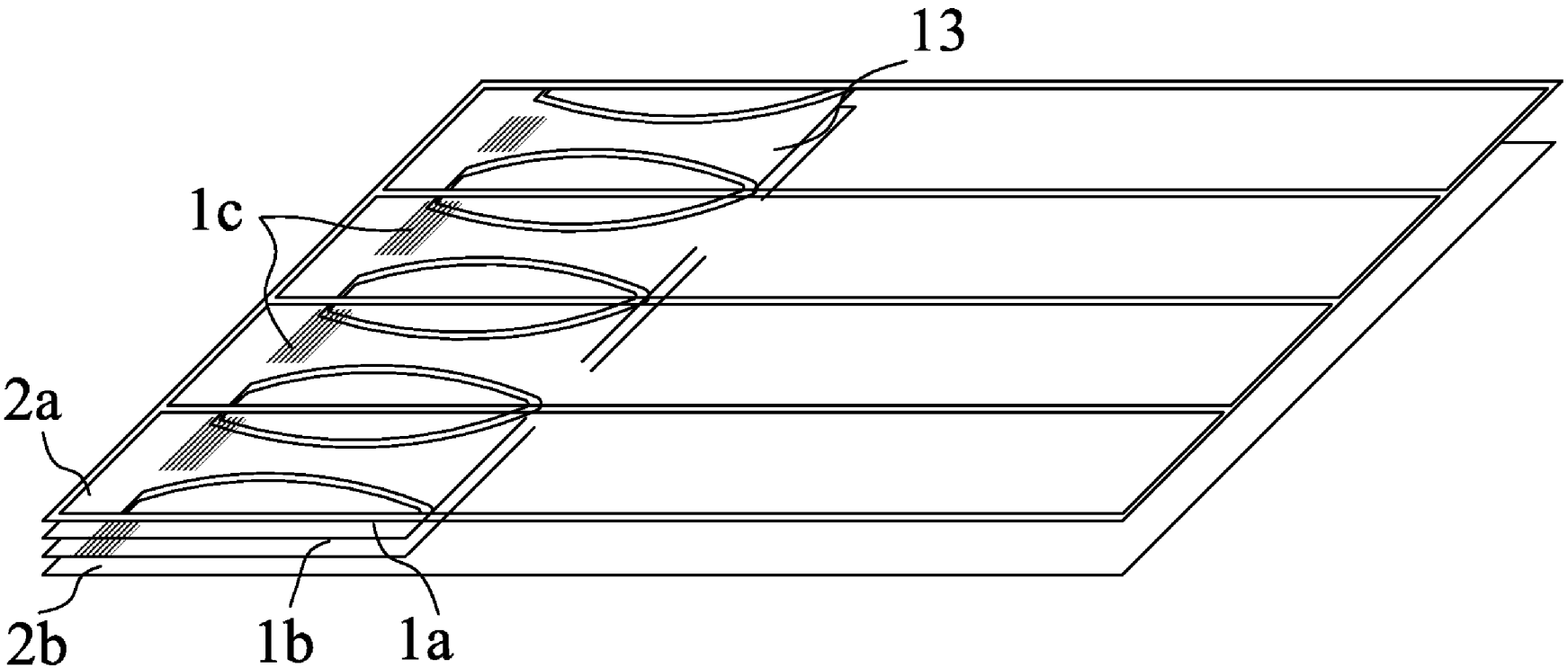
FIG. 8C is another schematic view, showing a nodal single-directional air filling air enclosure before air filling according to the present invention.
Figure 8D:
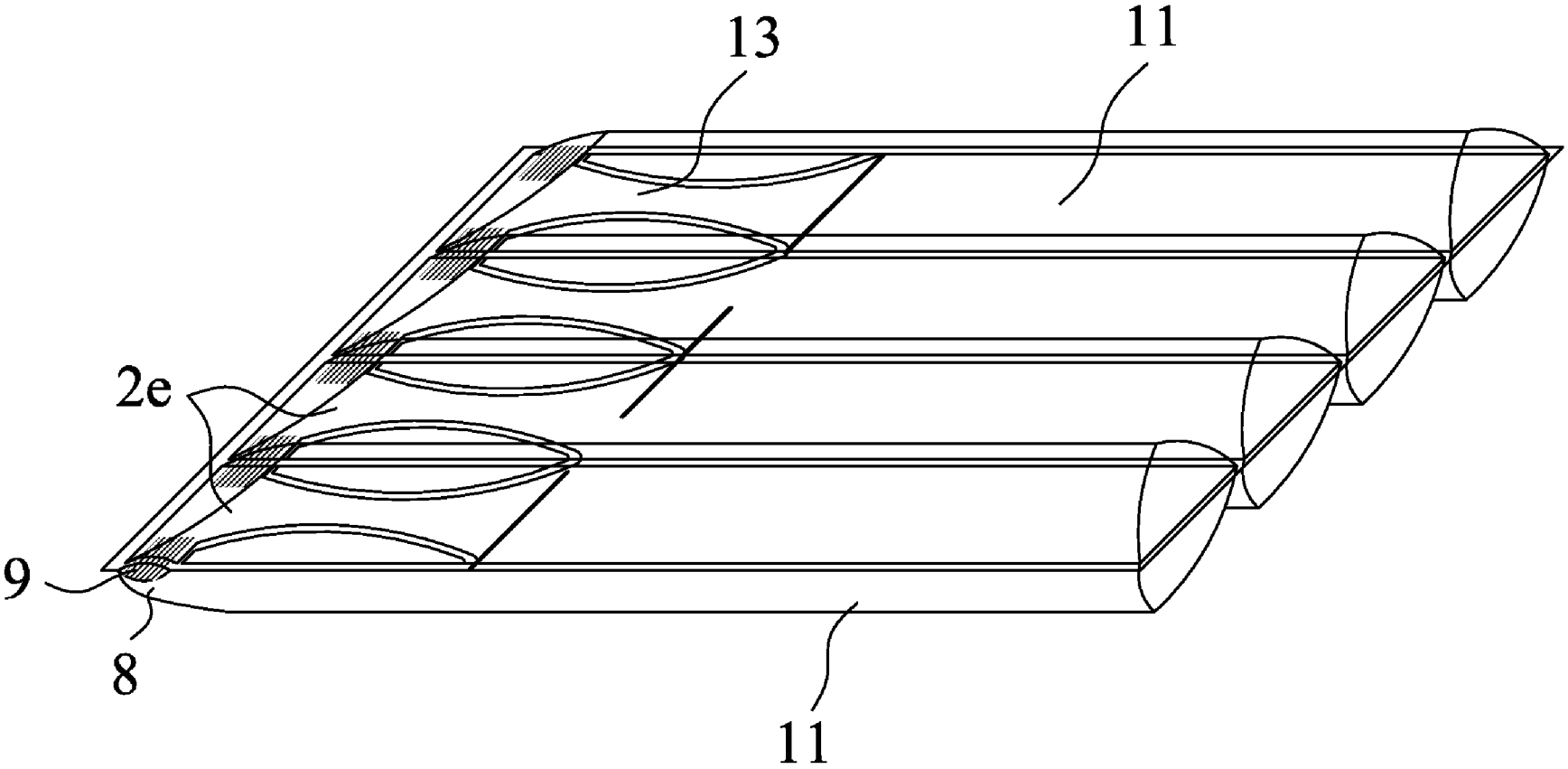
FIG. 8D is another schematic view, showing a nodal single-directional air filling air enclosure after air filling according to the present invention.

Please refer to FIGS. 8C and 8D. FIG. 8C is another schematic view, showing a nodal single-directional air filling air enclosure before air filling according to the present invention. FIG. 8D is another schematic view, showing a nodal single-directional air filling air enclosure after air filling according to the present invention.

A heat resistant material 1*c* is spread on the positions that hot sealing lines 3*e* are passed through an air filling passageway 9 at the inner surface of two inner films 1*a* and 1*b*, and the heat resistant material 1*c* is spread equidistantly with length approximately 1.2 centimeters and width approximately 1 centimeter. Air flows along the air filling passageway 9 to sequentially open the air inlet 2*e* of each air chamber 11 when air is filled and then enters each air chamber 11 and flows into a buffer room 8 via the air chamber 11 according to a preset air progressing route to cause the air chambers 11 and the buffer rooms 8 to be filled with air and expanded. Thereafter, the inner air pressure of the air chamber 11 and the buffer room 8 presses the two inner films 1*a* and 1*b* to form the air locking and further to shield the air filling passageway 9 and the air inlet 2*e* thereby enable the air in the air chamber 11 to be unable to flow back to strengthen the airtight function.

Figure 9A:
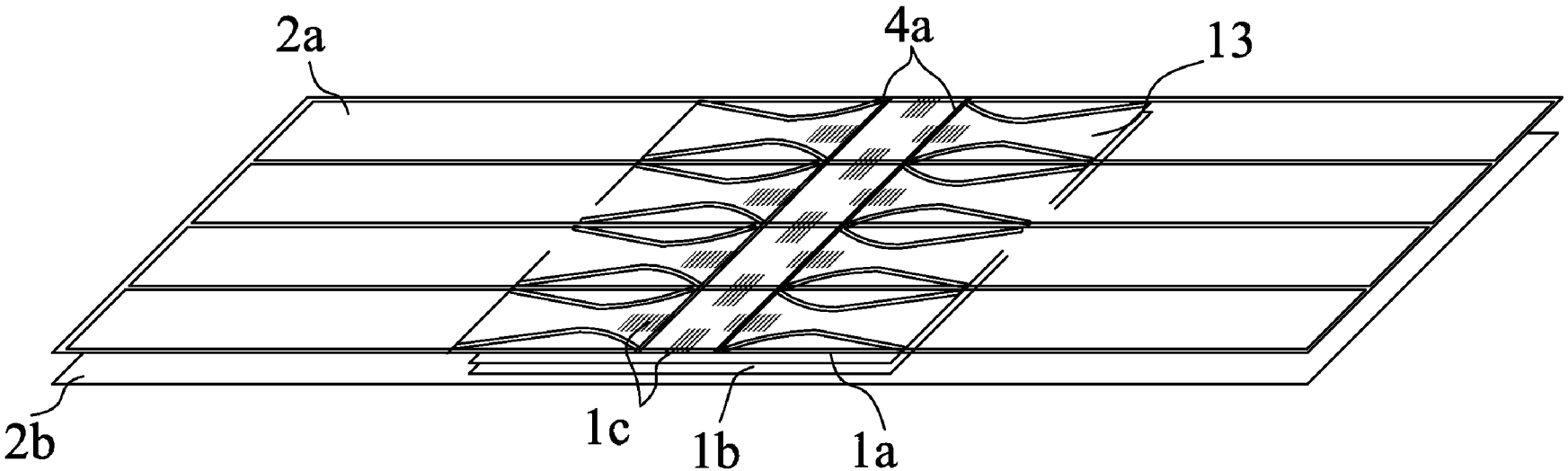
FIG. 9A is a schematic view, showing a nodal double-directional air filling air enclosure before air filling according to the present invention.
Figure 9B:
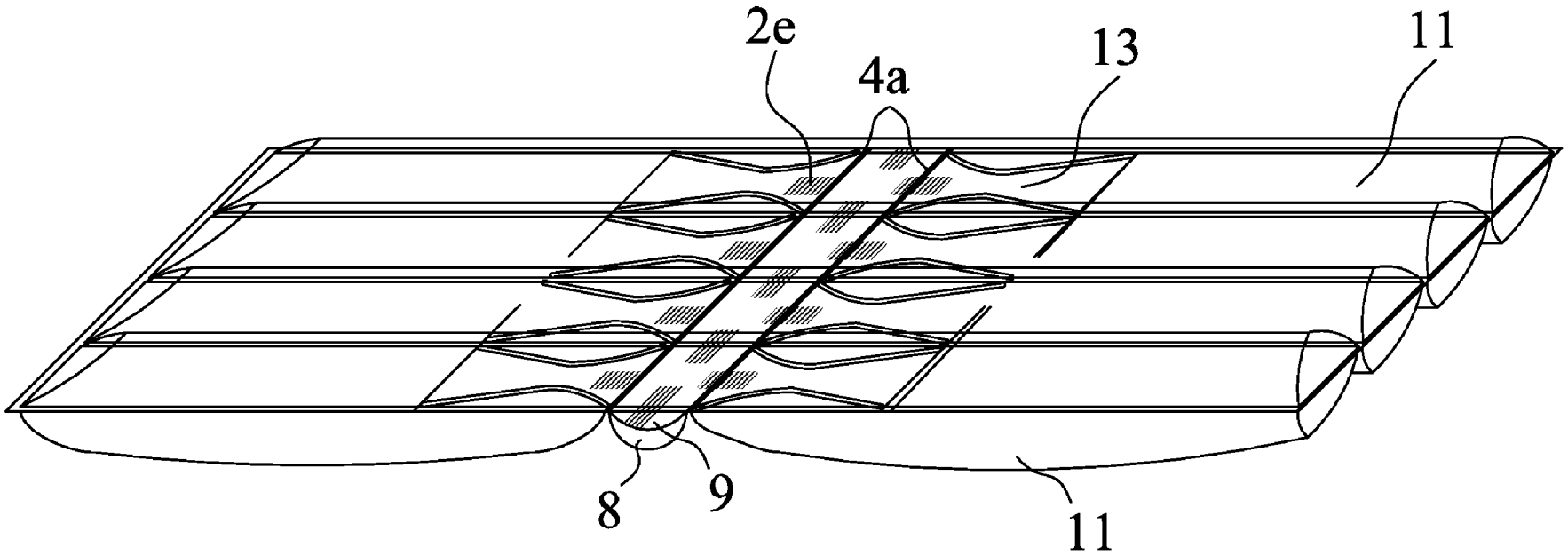
FIG. 9B is a schematic view, showing a nodal double-directional air filling air enclosure after air filling according to the present invention.

Please refer to FIGS. 9A and 9B. FIG. 9A is a schematic view, showing a nodal double-directional air filling air enclosure before air filling according to the present invention. FIG. 9B is a schematic view, showing a nodal double-directional air filling air enclosure after air filling according to the present invention.

An air filling passageway 9 is positioned in the middle of two outer films 2*a* and 2*b*, a heat resistant material 1*c* is spread on the positions that hot sealing lines 3*e* are passed through an air filling passageway 9 at the inner surface of two inner films 1*a* and 1*b*, and the heat resistant material 1*c* is spread equidistantly with length approximately 1.2 centimeters and width approximately 1 centimeter to form air inlets 2*e*. Furthermore, a plurality of air chambers 11 are formed at the two ends of the air filling passageway 9, the air chambers 11 at the two ends of the air filling passageway 9 are respectively independent and not communicated with one another as well as partitioning lines 4*a* are formed between the air filling passageway 9 and the air chambers by means of hot sealing.

Air flows through the air inlet 2*e* and enter each air chamber 11 in sequence via an air filling entrance 12 and along the air filling passageway 9 to cause the air chambers 11 at the side of the partitioning line 4*a* to be filled with air and expanded. Thereafter, the inner air pressure of the air chamber 11 presses the two inner films 1*a* and 1*b* to form the air locking to enable the air enclosure to be airtight. If the partitioning line 4*a* is loosed, the air in the air chamber 11 is passed through the partitioning line 4*a* and flows into a buffer room 8. Further, the inner air pressure of the buffer room 8 will press the two inner films 1*a* and 1*b* and further to shield the air filling passageway 9 and the air inlet 2*e* and thereby be taken as a second line of defense for preventing the air of the air enclosure from being leaked out. Furthermore, the air in the air filling passageway 9 is filled into the air chambers 11 at the two ends simultaneously; it can attain to the air filling time shortening purpose.

Figure 9C:
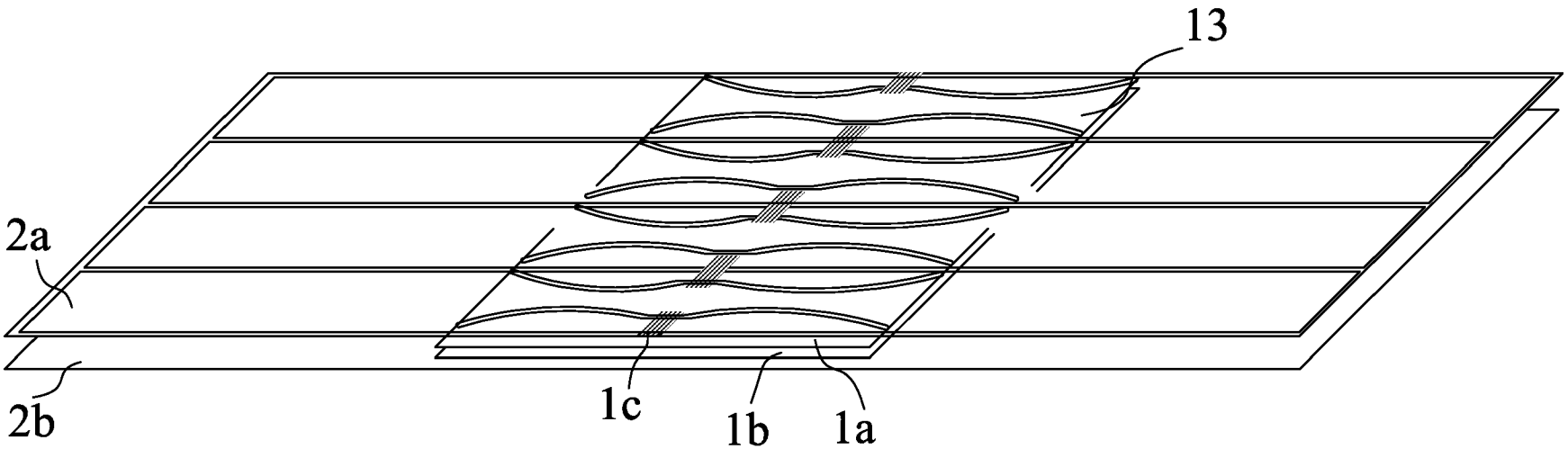
FIG. 9C is another schematic view, showing a nodal double-directional air filling air enclosure before air filling according to the present invention.
Figure 9D:
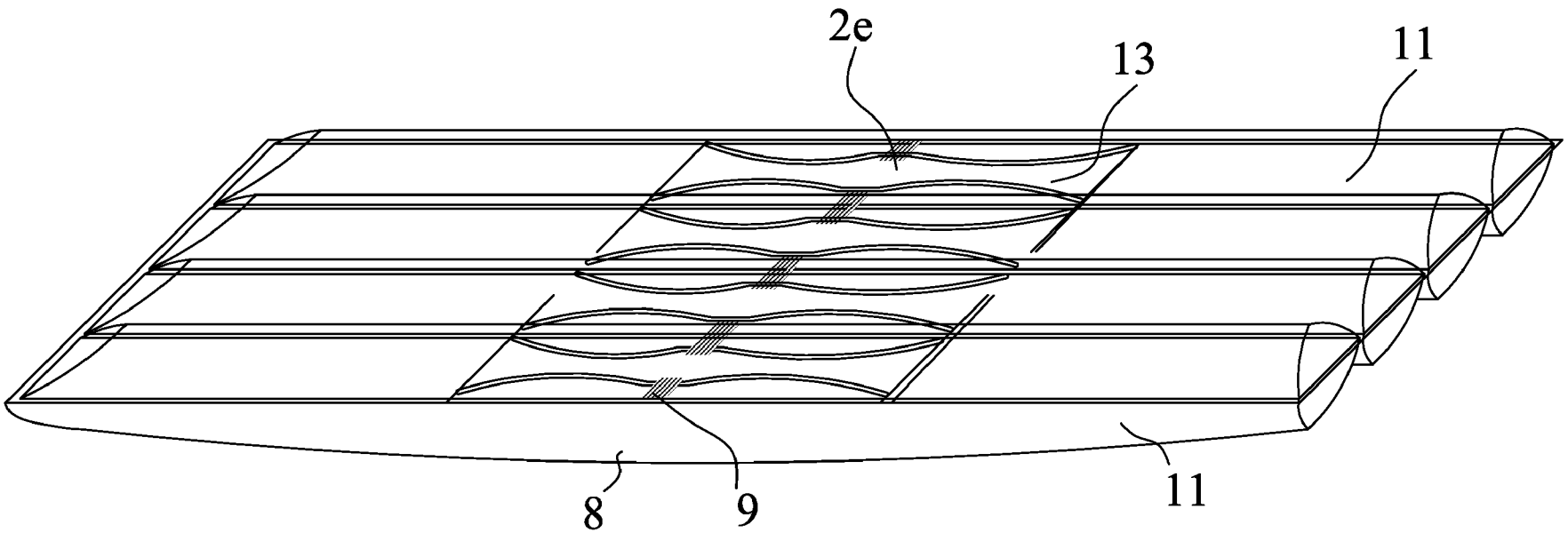
FIG. 9D is another schematic view, showing a nodal double-directional air filling air enclosure after air filling according to the present invention.

Please refer to FIGS. 9C and 9D. FIG. 9C is another schematic view, showing a nodal double-directional air filling air enclosure before air filling according to the present invention. FIG. 9D is another schematic view, showing a nodal double-directional air filling air enclosure after air filling according to the present invention.

An air filling passageway 9 is positioned in the middle of two outer films 2*a* and 2*b* and a plurality of air chambers 11 are formed at two ends of the air filling passageway 9, a heat resistant material 1*c* is spread on the positions that hot sealing lines 3*e* are passed through the air filling passageway 9 at the inner surface of two inner films 1*a* and 1*b*, and the heat resistant material 1*c* is spread equidistantly with length approximately 1.2 centimeters and width approximately 1 centimeter to form air inlets 2*e*. Air flows through the air inlet 2*e* and enter each air chamber 11 in sequence via an air filling entrance 12 and along the air filling passageway 9 and flows into a buffer room 8 via the air chamber 11 to cause the air chambers 11 and the buffer rooms 8 to be filled with air and expanded. Thereafter, the inner air pressure of the air chamber 11 and the buffer room 8 presses the two inner films 1*a* and 1*b* to form the air locking and further to shield the air filling passageway 9 and the air inlet 2*e*. If the partitioning line 4*a* is loosed, the air in the air chamber 11 is passed through the partitioning line 4*a* and flows into a buffer room 8. Further, the inner air pressure of the buffer room 8 will press the two inner films 1*a* and 1*b* and further to shield the air filling passageway 9 and the air inlet 2*e* thereby enable the air in the air chamber 11 to be unable to flow back to strengthen the airtight function.

Figure 10A:
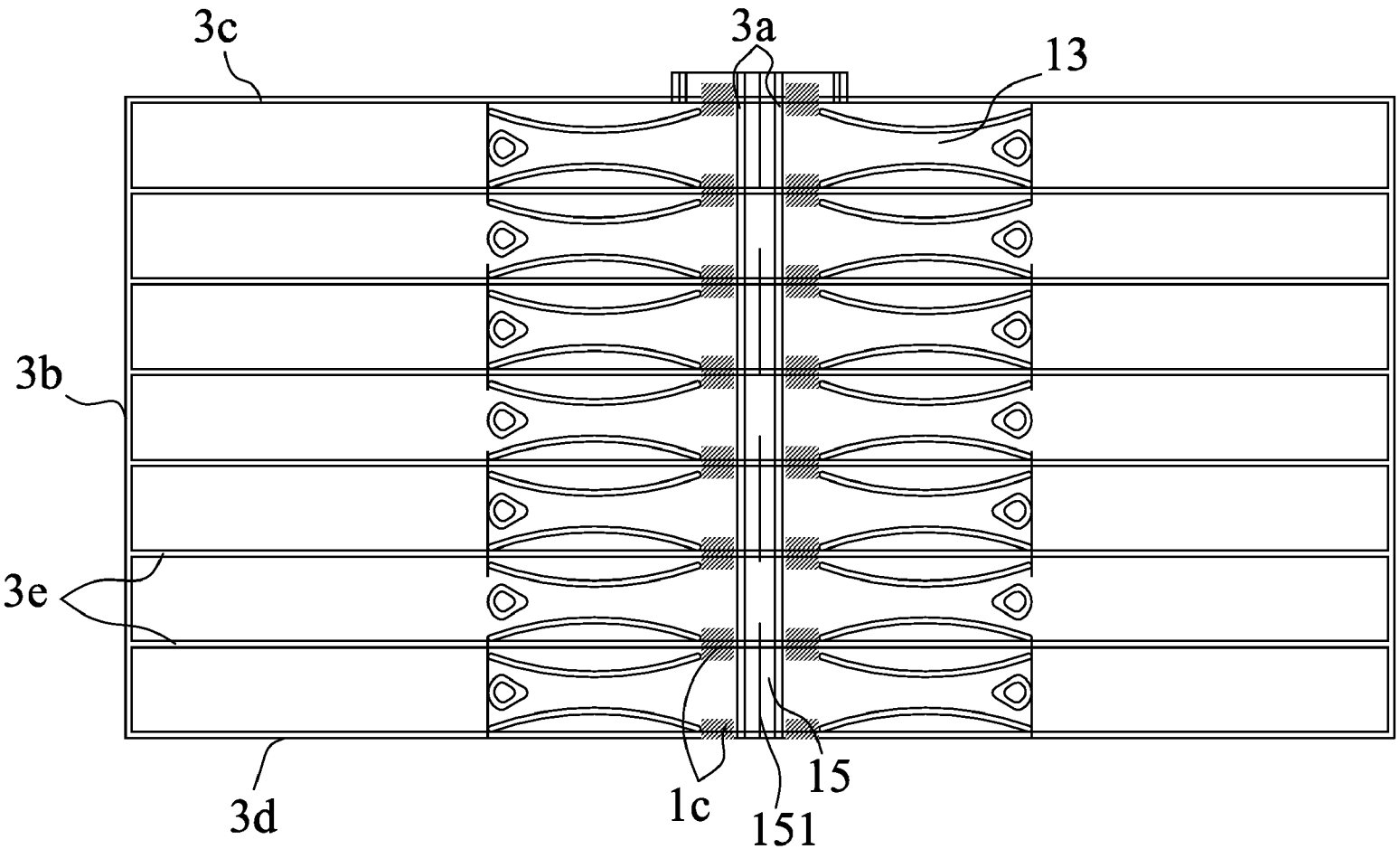
FIG. 10A is a schematic view, showing a divisible air enclosure before air filling according to the present invention.
Figure 10B:
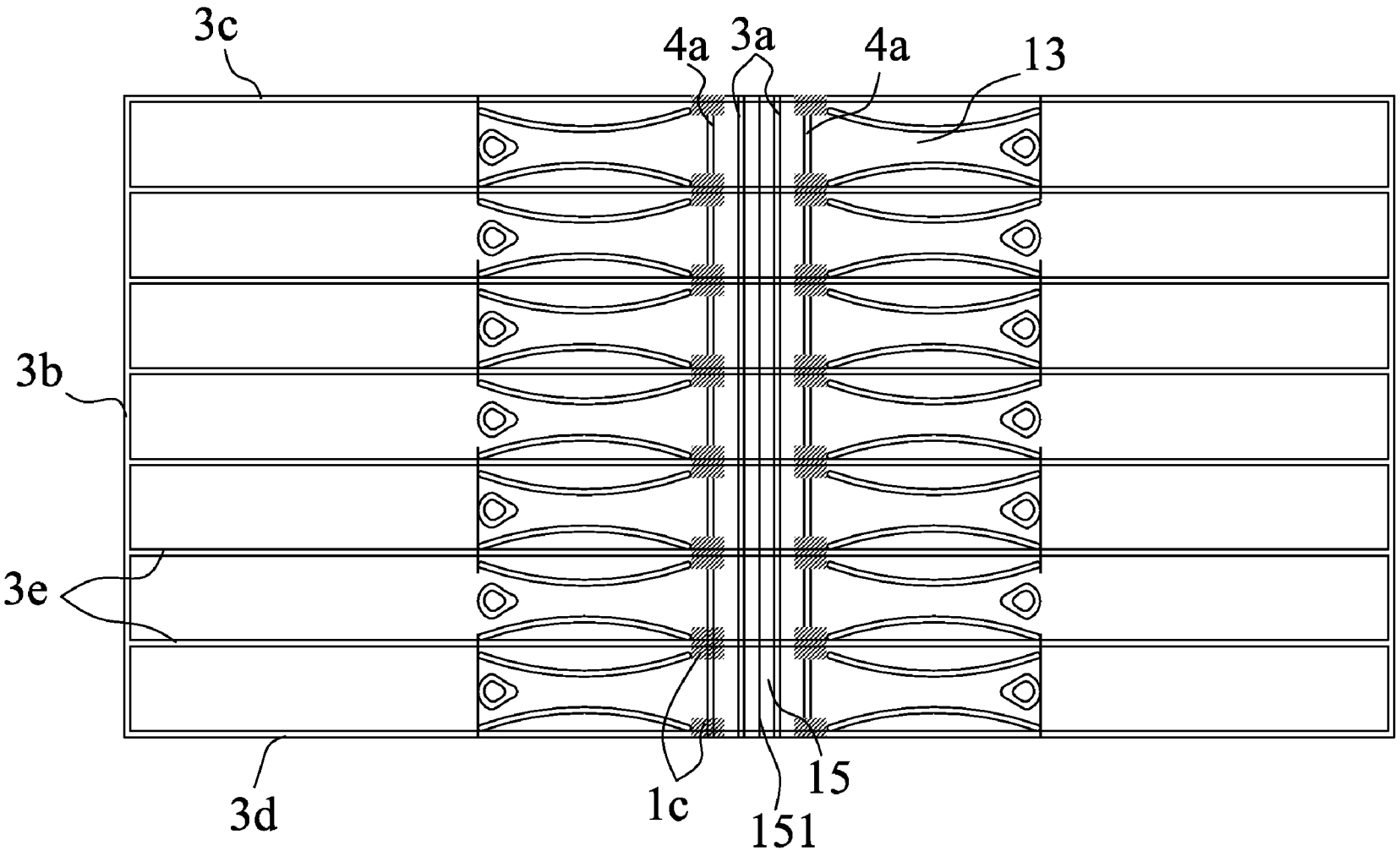
FIG. 10B is a schematic view, showing another divisible air enclosure before air filling according to the present invention.

Please refer to FIGS. 10A and 10B. FIG. 10A is a schematic view, showing a divisible air enclosure before air filling according to the present invention. FIG. 10B is a schematic view, showing another divisible air enclosure before air filling according to the present invention.

A cutting zone 15 positioned between two hot sealing lines 3*a* or between two partitioning lines 4*a* can be disposed on an air filling passageway 9. After the air filling is completed, it can then be cut along a cutting line 151 of the cutting zone to cause air chambers at two ends of the air filling passageway 9 to be separated from each other to enable the output of air enclosures to be doubled.

According to the structures disclosed by the present invention, the heat resistant material 1*c* spread between the two inner films 1*a* and 1*b* can be T type or square type and is extended from the air filling passageway 9 to the air chamber 11 so as to communicate the air filling passageway 9 with the air chamber 11. Furthermore, the air filling passageway 9 can be connected with one air inlet 2*e* or a plurality of air inlets 2*e*, each air chamber 11 can be connected with one air passageway 13 or a plurality of air passageways 13, and each two air chambers 11 can be communicated with each other and further to share one air passageway 13 or a plurality of air passageways 13.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An air-tightness strengthening air enclosure, comprising:

two outer films, folded together vertically;

two inner films having an upper side and a lower side, disposed between the two outer films, one end of the either inner film being aligned with one end of the either outer film at said lower side;

an air filling passageway, being an air passable space formed by adhering the two inner films to each other by means of hot sealing at said lower side;

a plurality of air chambers, positioned at one side of the air filling passageway and being air storable spaces formed by adhering the two outer films to each other by means of hot sealing;

at least one air inlet at said upper side of said air filling passageway, formed by means of hot sealing after a heat resistant material is spread sequentially and separately between the two inner films and used for communicating the air filling passageway with the air chambers; and at least one buffer room, disposed at one side of the air filling passageway, formed between the adjacent single outer film and single inner film and used for storing air;

wherein, the air in the buffer room presses the two inner films to shield the air filling passage to prevent air leakage after the air in the air chamber flows into the buffer room.

2. The air enclosure according to claim 1, further comprising at least one partitioning line disposed between the air filling passageway and the air chamber and the air inlet being formed on the partitioning line.

3. The air enclosure according to claim 1, wherein the air filling passageway is positioned on one end of the two outer films or in the middle of the two outer films.

4. The air enclosure according to claim 1, wherein the heat resistant material is extended from the air filling passageway to the air chamber.

5. The air enclosure according to claim 1, wherein the air chamber comprises an air passageway connected to the air inlet.

6. The air enclosure according to claim 1, wherein the plurality of air chambers are communicated with one another and share the single air inlet.

7. The air enclosure according to claim 1, wherein the plurality of air chambers are communicated with one another and share the plurality of air inlets.

8. The air enclosure according to claim 1, wherein the air filling passageway is formed by spreading the heat resistant material between the two inner films and then adhering the two inner films by means of hot sealing, and the length of the heat resistant material is approximately equal to the width of the outer film.

9. The air enclosure according to claim 1, wherein the air filling passageway comprises a cutting zone, the air chambers at two sides of the air filling passageway is enabled to separate from each other by cutting along the cutting zone.

10. An air-tightness strengthening air enclosure, comprising:

an upper film;

a lower film, folded with the upper film to form an outer film;

an inner film, disposed between the upper film and the lower film such that one end of the inner film is aligned with one end of the outer film;

an air filling passageway, being an air passable space formed by adhering the inner film to the upper film by means of hot sealing;

a plurality of air chambers, positioned at one side of the air filling passageway and being air storable spaces formed by adhering the upper film to the lower film by means of hot sealing;

at least one air inlet, formed by adhering the inner film to the upper film by means of hot sealing after a heat resistant material is spread sequentially and separately between the inner film and the upper film and used for communicating the air filling passageway with the air chambers; and a buffer room, disposed at one side of the air filling passageway, formed between the outer film and the inner film and used for storing air;

wherein, the air in the buffer room presses the inner film to shield the air filling passage to prevent air leakage after the air in the air chamber flows into the buffer room.

11. The air enclosure according to claim 10, further comprising at least one partitioning line disposed between the air filling passageway and the air chamber and the air inlet being formed on the partitioning line.

12. The air enclosure according to claim 10, wherein the heat resistant material is extended from the air filling passageway to the air chamber.

13. The air enclosure according to claim 10, wherein the air chamber comprises an air passageway connected to the air inlet.

14. The air enclosure according to claim 10, wherein the plurality of air chambers are communicated with one another and share the single air inlet.

15. The air enclosure according to claim 10, wherein the plurality of air chambers are communicated with one another and share the plurality of air inlets.

16. The air enclosure according to claim 10, wherein a upper side of the inner film is lined up with upper sides of the upper film and the lower film.

17. The air enclosure according to claim 10, wherein the air filling passageway is formed by spreading the heat resistant material between the inner film and the upper film and then adhering the inner film and the upper film by means of hot sealing, and the length of the heat resistant material is approximately equal to the width of the outer film.

18. The air enclosure according to claim 10, wherein the air filling passageway comprises a cutting zone, the air chambers at two sides of the air filling passageway is enabled to separate from each other by cutting along the cutting zone.

* * * * *